US009585431B2

(12) United States Patent
Waters

(10) Patent No.: US 9,585,431 B2
(45) **Date of Patent: *Mar. 7, 2017**

(54) LIGHTED HAT

(71) Applicant: Waters Industries, Inc., West Dundee, IL (US)

(72) Inventor: Michael Waters, West Dundee, IL (US)

(73) Assignee: Waters Industries, Inc., West Dundee, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/047,914

(22) Filed: Oct. 7, 2013

(65) Prior Publication Data

US 2014/0192518 A1 Jul. 10, 2014

Related U.S. Application Data

(63) Continuation of application No. 12/714,403, filed on Feb. 26, 2010, now Pat. No. 8,550,651, which is a (Continued)

(51) Int. Cl.
*A42B 1/24* (2006.01)
*F21L 4/02* (2006.01)
(Continued)

(52) U.S. Cl.
CPC ..... *A42B 1/244* (2013.01); *F21L 4/027* (2013.01); *F21V 21/0885* (2013.01); *F21Y 2101/02* (2013.01)

(58) Field of Classification Search
CPC ..... A42B 1/244; A42B 3/044; A42B 3/0446; A42B 3/0453; A42B 1/242; F21L 4/027; F21V 21/0885; F21V 33/00; F21Y 2101/02
(Continued)

(56) References Cited

U.S. PATENT DOCUMENTS 645,984 A 3/1900 Tournier
909,742 A 1/1909 Borchert
(Continued)

FOREIGN PATENT DOCUMENTS

AU 1178576 9/1977
AU 6310994 11/1994
(Continued)

OTHER PUBLICATIONS

'Initial Non-Infringement, Invalidity and Unenforceability, Contentions' with Exhibit A, Exhibits B-1 and B-2, and Exhibits C-1 through C7, *Waters Industries, Inc.* v. *Outdoor Cap Co., Inc.*, United States District Court for the Northern District of Illinois, Case No. 1:13-cv-07191, 263 pages (Dec. 18, 2013).
(Continued)

*Primary Examiner* — Bao Q Truong
(74) *Attorney, Agent, or Firm* — Fitch, Even, Tabin & Flannery LLP

(57) ABSTRACT

There is provided hands-free lighting, components thereof, and other accessories combined with the hands-free lighting. The hands-free lighting is preferably lighted headgear including hats or visors or other headgear. The hands-free lighting may include multiple light sources positioned at the brim of a lighted hat and configured to provide beams of illumination along different axes thereby illuminating distances both near and far from the wearer at the same time while maintaining natural and streamlined appearance of the lighted hat.

27 Claims, 22 Drawing Sheets

Related U.S. Application Data continuation-in-part of application No. PCT/US2008/087542, filed on Dec. 18, 2008.

(60) Provisional application No. 61/156,464, filed on Feb. 27, 2009, provisional application No. 61/014,726, filed on Dec. 18, 2007.

(51) Int. Cl.
*F21V 21/088* (2006.01)
*F21Y 101/02* (2006.01)

(58) Field of Classification Search
USPC ..... 362/105, 106, 107
See application file for complete search history.

(56) References Cited

U.S. PATENT DOCUMENTS 1,098,628 A 6/1914 Hyman
1,109,415 A 9/1914 Harris
1,261,824 A 1/1918 La Vine
1,255,265 A 2/1918 Zachara
1,323,822 A 12/1919 Bramming
D58,302 S 7/1921 Bartholomew
1,438,586 A 12/1922 Eaton
1,448,353 A 3/1923 Barany
1,475,653 A 11/1923 Rosenberg
1,572,210 A 2/1926 Kolibas
1,615,067 A 1/1927 Boerman
1,744,777 A 1/1930 Lundgren
1,749,998 A 3/1930 Collins
1,879,512 A 9/1932 Rotea
1,883,756 A 10/1932 Bloom
D114,980 S 1/1939 Wengen
2,196,543 A 4/1940 Anderson
2,373,553 A 10/1942 Fetterman
D137,375 S 2/1944 Heit
2,369,829 A 2/1945 Johnson
2,461,254 A 2/1949 Bassett
2,473,394 A 6/1949 Scott
2,531,585 A 11/1950 Pope
2,540,435 A 2/1951 Ferguson
2,552,764 A 5/1951 Bedford, Jr.
2,567,046 A 9/1951 Anderson
2,591,112 A 4/1952 Zwierzynski
2,638,532 A 5/1953 Brady
2,640,980 A 6/1953 Prupis
2,705,751 A 4/1955 Harris
2,730,720 A 1/1956 Saunders
2,788,439 A 4/1957 Hesse
2,904,670 A 9/1959 Calmes
2,966,580 A 12/1960 Taylor
2,978,696 A 4/1961 Keller
3,008,040 A 11/1961 Moore
3,032,647 A 5/1962 Wansky
3,040,881 A 6/1962 McNeill
3,057,992 A 10/1962 Baker
3,060,308 A 10/1962 Fortuna
3,123,208 A 3/1964 Barnum
3,184,058 A 5/1965 Crowther
3,201,771 A 8/1965 Proulx
D207,919 S 6/1967 Fai
3,350,552 A 10/1967 Lawrence
3,358,137 A 12/1967 Sinclair
3,447,164 A 6/1969 Greenhouse
D215,751 S 10/1969 Castellano
3,491,374 A 1/1970 Frangos
3,535,282 A 10/1970 Mallory
3,537,909 A 11/1970 Horton
3,602,759 A 8/1971 Evans
3,634,676 A 1/1972 Castellano
3,647,059 A 3/1972 Humphreys
3,666,901 A 5/1972 Weinhart
3,683,168 A 8/1972 Tatje
3,749,902 A 7/1973 Drew
3,769,663 A 11/1973 Perl
D229,975 S 1/1974 Klugmann
3,793,517 A 2/1974 Carlini
3,845,389 A 10/1974 Phillips
3,947,676 A 3/1976 Battilana
3,963,917 A 6/1976 Romano
4,005,776 A 2/1977 Seeley
4,011,600 A 3/1977 Malk
4,053,688 A 10/1977 Perkins
4,092,704 A 5/1978 Malm
4,176,932 A 12/1979 Young
4,186,429 A 1/1980 Johnston
4,210,952 A 7/1980 Ressmeyer
4,231,079 A 10/1980 Heminover
4,254,451 A 3/1981 Cochran
4,268,894 A 5/1981 Bartunek
4,270,227 A 6/1981 Wolfe
4,283,127 A 8/1981 Rosenwinkel
4,298,913 A 11/1981 Lozar
4,317,162 A 2/1982 Richards et al.
4,332,007 A 5/1982 Gibstein
4,364,107 A 12/1982 Wieczorek
4,392,183 A 7/1983 Ostlund
4,398,237 A 8/1983 Doyel
4,406,040 A 9/1983 Cannone
4,425,531 A 1/1984 Holmes
D272,733 S 2/1984 Cosmos
4,430,532 A 2/1984 Matsumoto
4,442,478 A 4/1984 Stansbury
4,462,064 A 7/1984 Schweitzer
4,470,263 A 9/1984 Lehovec
4,483,021 A 11/1984 McCall
4,516,157 A 5/1985 Campbell
4,521,831 A 6/1985 Thayer
4,541,698 A 9/1985 Lerner
4,551,857 A 11/1985 Galvin
4,559,516 A 12/1985 Schott
4,570,206 A 2/1986 Deutsch
4,602,191 A 7/1986 Davila
4,604,760 A 8/1986 Coin
4,616,297 A 10/1986 Liu
4,631,644 A 12/1986 Dannhauer
4,638,410 A 1/1987 Barker
4,641,647 A 2/1987 Behan
4,642,817 A 2/1987 Ferstenfeld
4,665,568 A 5/1987 Stutes
4,667,274 A 5/1987 Daniel
4,669,610 A 6/1987 Lindsey
4,680,815 A 7/1987 Hirsch
4,774,643 A 9/1988 McGinnis
4,794,496 A 12/1988 Lanes
4,817,212 A 4/1989 Benoit
4,822,160 A 4/1989 Tsai
4,822,161 A 4/1989 Jimmy
4,827,384 A 5/1989 VonSchlemmer
4,829,285 A 5/1989 Brand
4,872,218 A 10/1989 Holt
4,875,147 A 10/1989 Auer
4,884,067 A 11/1989 Nordholm
4,901,210 A 2/1990 Hanabusa
4,901,211 A 2/1990 Shen
4,902,119 A 2/1990 Porsche
4,904,078 A 2/1990 Gorike
4,920,466 A 4/1990 Liu
4,945,458 A 7/1990 Batts
4,951,068 A 8/1990 Ichikawa
4,959,760 A 9/1990 Wu
4,963,045 A 10/1990 Willcox
4,991,068 A 2/1991 Mickey
4,998,187 A 3/1991 Herrick
5,003,640 A 4/1991 Pizzacar
D316,932 S 5/1991 Escher, Jr.
5,039,829 A 8/1991 Brucksch
5,060,814 A 10/1991 Oglesbee
5,068,771 A 11/1991 Savage, Jr.
5,070,436 A 12/1991 Alexander
5,088,127 A 2/1992 Thornock
5,111,366 A 5/1992 Rife
5,113,325 A 5/1992 Eisenbraun

(56) References Cited

U.S. PATENT DOCUMENTS 5,117,510 A 6/1992 Broussard
5,122,943 A 6/1992 Pugh
5,138,538 A 8/1992 Sperling
5,140,116 A 8/1992 Schmitt-Walter
5,140,220 A 8/1992 Hasegawa
5,143,443 A 9/1992 Madsen
5,158,356 A 10/1992 Guthrie
5,163,420 A 11/1992 VanDerBel
5,164,749 A 11/1992 Shelton
5,165,789 A 11/1992 Womack
5,183,326 A 2/1993 Case
5,189,512 A 2/1993 Cameron
5,193,220 A 3/1993 Ichinohe
5,193,347 A 3/1993 Apisdorf
5,207,500 A 5/1993 Rios
5,218,385 A 6/1993 Lii
5,224,772 A 7/1993 Fustos
5,230,558 A 7/1993 Jong
5,238,344 A 8/1993 Nagayama
5,245,516 A 9/1993 deHaas
5,249,675 A 10/1993 Strauss
D343,470 S 1/1994 Yuen
5,278,734 A 1/1994 Ferber
D349,123 S 7/1994 Cooley
5,329,637 A 7/1994 Walker
5,331,333 A 7/1994 Tagawa
5,331,357 A 7/1994 Cooley
5,353,205 A 10/1994 Hudak
5,357,409 A 10/1994 Glatt
5,363,291 A 11/1994 Steiner
5,367,345 A 11/1994 da Silva
5,404,593 A 4/1995 Kronenberger
5,408,393 A 4/1995 Becker
5,410,746 A 4/1995 Gelber
5,412,545 A 5/1995 Rising
5,418,565 A 5/1995 Smith
5,423,419 A 6/1995 Wentz
5,438,698 A 8/1995 Burton
5,452,190 A 9/1995 Priesemuth
5,460,346 A 10/1995 Hirsch
5,463,538 A 10/1995 Womack
5,467,992 A 11/1995 Harkness
5,485,358 A 1/1996 Chien
5,488,361 A 1/1996 Perry
5,503,637 A 4/1996 Kyricos
5,508,900 A 4/1996 Norman
5,510,961 A 4/1996 Peng
5,541,767 A 7/1996 Murphy
5,541,816 A * 7/1996 Miserendino ..... 362/106
5,542,627 A 8/1996 Crenshaw
5,546,099 A 8/1996 Quint
5,564,128 A 10/1996 Richardson
5,567,038 A 10/1996 Lary
D375,372 S 11/1996 Allen
5,575,554 A 11/1996 Guritz
5,601,358 A 2/1997 Chien
5,606,743 A 2/1997 Vogt
5,608,808 A 3/1997 da Silva
5,610,678 A 3/1997 Tsuboi
5,644,189 A 7/1997 Busby
5,655,374 A 8/1997 Santilli
D383,754 S 9/1997 Yuen
D383,863 S 9/1997 Yuen
5,667,291 A 9/1997 Caplan
5,667,292 A 9/1997 Sabalvaro, Jr.
5,676,449 A 10/1997 Newsome
5,677,079 A 10/1997 DeZorzi
5,680,718 A 10/1997 Ratcliffe
5,688,039 A 11/1997 Johnson
D388,113 S 12/1997 Feinbloom
5,692,244 A 12/1997 Johnson
5,708,449 A 1/1998 Heacock
5,709,464 A 1/1998 Tseng
5,718,335 A 2/1998 Boudreaux
5,722,762 A 3/1998 Soll
5,730,290 A 3/1998 Futo
5,741,060 A * 4/1998 Johnson ..... 362/106
5,743,621 A 4/1998 Mantha
5,758,947 A 6/1998 Glatt
5,774,338 A 6/1998 Wessling, III
5,786,665 A 7/1998 Ohtsuki
5,800,278 A 9/1998 Varriano
5,806,961 A 9/1998 Dalton
5,822,636 A 10/1998 Cho
5,829,063 A 11/1998 Cheng
5,829,860 A 11/1998 Lawther
5,836,673 A 11/1998 Lo
5,845,778 A 12/1998 Hickey, Jr.
5,845,987 A 12/1998 Painter
5,857,220 A 1/1999 Erny
5,865,333 A 2/1999 Wolfe
5,871,271 A 2/1999 Chien
D407,187 S 3/1999 Makki
5,876,241 A 3/1999 Frantz
5,893,631 A 4/1999 Padden
5,894,604 A 4/1999 Crabb
5,918,966 A 7/1999 Arnold
5,920,910 A 7/1999 Calvo
5,921,674 A 7/1999 Koczi
5,922,489 A 7/1999 Adachi
5,931,693 A 8/1999 Yamazaki
5,946,071 A 8/1999 Feldman
5,982,969 A 11/1999 Sugiyama
5,997,165 A 12/1999 Lehrer
6,005,536 A 12/1999 Beadles
6,007,212 A 12/1999 Chan
6,007,213 A 12/1999 Baumgartner
6,009,563 A 1/2000 Swanson
6,012,822 A 1/2000 Robinson
6,012,827 A 1/2000 Caplan
D420,035 S 2/2000 Hartman
D420,207 S 2/2000 Barton
6,021,525 A 2/2000 Mertins
6,023,788 A 2/2000 McCallum
6,028,627 A 2/2000 Helmsderfer
6,032,291 A 3/2000 Asenguah
6,032,293 A 3/2000 Makki
6,056,413 A * 5/2000 Urso ..... 362/106
D428,431 S 7/2000 Jordan
6,086,214 A 7/2000 Ridge
6,087,037 A 7/2000 Rieder
6,088,053 A 7/2000 Hammack
6,094,749 A 8/2000 Proctor
6,113,243 A 9/2000 Saul
6,113,244 A 9/2000 Baumgartner
6,116,745 A 9/2000 Yei
6,124,056 A 9/2000 Kimura
6,126,294 A 10/2000 Koyama
6,167,570 B1 1/2001 Su
6,168,286 B1 1/2001 Duffy
6,172,657 B1 1/2001 Kamakura
6,174,075 B1 1/2001 Fuwausa
6,176,601 B1 1/2001 Nester
6,206,543 B1 3/2001 Henry
6,236,007 B1 5/2001 Ho
6,237,147 B1 5/2001 Brockman
6,240,566 B1 6/2001 Scantlin
6,244,721 B1 6/2001 Rodriguez
6,250,769 B1 6/2001 Kirk
D445,928 S 7/2001 Sharrah
6,256,795 B1 7/2001 Habel
D446,324 S 8/2001 Lynch
6,290,368 B1 9/2001 Lehrer
6,299,323 B1 10/2001 Yu
6,302,570 B1 10/2001 Petell
6,306,538 B1 10/2001 Saitoh
6,307,526 B1 10/2001 Mann
6,311,350 B1 11/2001 Kaiserman
6,311,837 B1 11/2001 Blaustein
6,320,822 B1 11/2001 Okeya
6,325,521 B1 12/2001 Gregg
6,328,454 B1 12/2001 Davis
6,340,234 B1 1/2002 Brown, Jr.
6,345,716 B1 2/2002 Chapman

(56) References Cited

U.S. PATENT DOCUMENTS 6,347,410 B1 2/2002 Lee
6,363,537 B1 4/2002 Park
6,366,344 B1 4/2002 Lach
6,367,949 B1 4/2002 Pederson
D457,670 S 5/2002 Allen
6,382,407 B1 5/2002 Chao
6,386,701 B1 5/2002 Khulusi
6,390,640 B1 5/2002 Wong
6,398,386 B1 6/2002 Huang
6,416,199 B1 7/2002 Heine
6,431,904 B1 8/2002 Berelsman
6,439,738 B1 8/2002 Matthews
6,442,764 B1 9/2002 Badillo
6,457,838 B1 10/2002 Dugmore
6,461,015 B1 10/2002 Welch
6,461,025 B1 10/2002 Payne
6,474,830 B1 11/2002 Hansen
6,476,391 B1 11/2002 Zhang
6,497,493 B1 12/2002 Theisen
D469,198 S 1/2003 Olson
6,504,099 B2 1/2003 Huang
6,523,973 B2 2/2003 Galli
6,530,672 B2 3/2003 Galli
6,538,567 B2 3/2003 Stewart
D473,890 S 4/2003 Waters
6,549,231 B1 4/2003 Matsui
6,553,570 B1 4/2003 Flynn
6,554,444 B2 4/2003 Shimada
6,578,982 B1 6/2003 Lynch
D477,432 S 7/2003 Parsons
6,598,991 B2 7/2003 Altman
6,604,837 B2 8/2003 Sandberg
6,612,695 B2 9/2003 Waters
6,612,696 B2 9/2003 Waters
6,616,293 B2 9/2003 Mickey
6,634,031 B1 10/2003 Schlapkohl
6,642,667 B2 11/2003 Avis
D483,928 S 12/2003 Mansell
6,659,618 B2 12/2003 Waters
D484,905 S 1/2004 Waters
6,679,615 B2 1/2004 Spearing
6,704,044 B1 3/2004 Foster
6,709,142 B2 3/2004 Gyori
6,713,956 B2 3/2004 HsingChen
6,715,309 B1 4/2004 Junkins
6,719,437 B2 4/2004 Lary
6,721,962 B1 4/2004 Polaire
D489,165 S 5/2004 Waters
6,733,150 B1 * 5/2004 Hanley ..... 362/106
6,749,166 B2 6/2004 Valentine
6,760,925 B1 7/2004 Maxwell
6,764,194 B1 7/2004 Cooper
6,802,636 B1 10/2004 Bailey, Jr.
6,808,284 B1 10/2004 Chao
6,811,441 B2 11/2004 Simpson
6,817,711 B2 11/2004 Schubert
6,830,357 B2 12/2004 Lopez
D501,266 S 1/2005 Harris
6,837,590 B2 1/2005 Marston
6,857,739 B1 2/2005 Watson
6,860,628 B2 3/2005 Robertson
6,863,416 B2 3/2005 Waters
6,865,285 B1 3/2005 Villa-Aleman
6,880,989 B2 4/2005 Sotome
6,908,208 B1 6/2005 Hyde
D507,368 S 7/2005 Waters
D507,369 S 7/2005 Waters
6,918,678 B2 7/2005 McClanahan
6,923,322 B2 8/2005 Lenker
6,929,375 B2 8/2005 Satomi
6,929,878 B2 8/2005 Chen
6,932,216 B2 8/2005 Blaustein
6,935,761 B2 8/2005 Vanderschuit
6,941,583 B2 9/2005 Yan
6,966,668 B2 11/2005 Cugini
6,969,178 B2 11/2005 Zuloff
6,977,776 B2 12/2005 Volkenandt
6,993,803 B2 2/2006 Chan
6,994,445 B1 2/2006 Pomes
6,997,552 B1 2/2006 Hung
7,000,841 B2 2/2006 Becker
7,003,353 B1 * 2/2006 Parkhouse ..... 607/45
7,004,439 B1 2/2006 Taylor
7,004,582 B2 2/2006 Jannard
7,008,074 B1 3/2006 Halm
7,021,790 B2 4/2006 Parsons
D520,460 S 5/2006 Wadsworth
7,052,154 B2 5/2006 Vanderschuit
7,055,179 B2 6/2006 Warner
7,086,749 B1 8/2006 Hanley
7,094,981 B2 8/2006 Sorrentino
7,104,670 B2 9/2006 Waters
7,105,939 B2 9/2006 Bednyak
7,111,956 B2 9/2006 Brown
7,114,823 B2 10/2006 McCullough et al.
7,118,241 B2 10/2006 Sohn
7,118,262 B2 10/2006 Negley
7,128,434 B1 10/2006 Nally
7,147,324 B2 12/2006 Jannard
7,147,338 B2 12/2006 Gregg
7,150,526 B2 12/2006 Jannard
7,163,309 B2 1/2007 Sohn
7,182,478 B2 2/2007 Marston
7,186,159 B1 3/2007 Baxter
7,192,151 B2 3/2007 Clupper
7,209,652 B2 4/2007 Uenaka
7,213,917 B2 5/2007 Jannard
7,216,973 B2 5/2007 Jannard
7,226,180 B2 6/2007 Sung
7,234,831 B1 6/2007 Hanley
7,255,437 B2 8/2007 Howell
7,264,350 B2 9/2007 Jannard
D553,177 S 10/2007 Chen
7,278,734 B2 10/2007 Jannard
7,281,826 B2 10/2007 Huang
7,318,654 B2 1/2008 McClanahan
7,331,064 B1 2/2008 Quintal
D566,044 S 4/2008 DArco
D568,922 S 5/2008 Anderl
7,369,174 B2 5/2008 Olita
7,377,664 B2 5/2008 Waters
7,427,149 B2 9/2008 Sohn
7,431,472 B2 10/2008 Becker
7,438,409 B2 10/2008 Jordan
7,457,536 B2 11/2008 Hamada
7,461,764 B2 12/2008 Thompson
7,466,040 B2 12/2008 Bruwer
7,470,022 B2 12/2008 Lerner
7,506,992 B2 3/2009 Carter
D591,675 S 5/2009 Waters
7,562,979 B2 7/2009 Waters
7,576,800 B2 8/2009 Swain
D600,208 S 9/2009 Waters
D600,738 S 9/2009 Su
7,598,928 B1 10/2009 Buskop
7,607,775 B2 10/2009 Hermanson
7,609,295 B2 10/2009 Aridome
7,611,255 B1 11/2009 Lagassey
7,621,000 B1 11/2009 Fulton
D605,381 S 12/2009 Mastrantonio et al.
7,661,818 B2 2/2010 Waters
D611,086 S 3/2010 Meng-Suen
7,677,751 B2 3/2010 Kinsman
7,699,486 B1 4/2010 Beiner
D617,826 S 6/2010 Waters
7,753,547 B2 7/2010 Waters
7,755,219 B2 7/2010 Bruwer
7,784,960 B2 8/2010 Lahtinen
7,862,979 B2 1/2011 Waters
7,934,846 B1 5/2011 Schwanz
7,938,553 B1 5/2011 Beiner
7,942,543 B2 5/2011 Ritter
8,002,437 B2 8/2011 Sohn
8,075,153 B2 12/2011 Werner

(56) References Cited

U.S. PATENT DOCUMENTS

| | | | | |
|---|---|---|---|---|
| 8,141,395 | B2 | 3/2012 | Dillavou | |
| 8,157,403 | B2 | 4/2012 | Lau | |
| D659,351 | S | 5/2012 | Benkendorfer | |
| 8,333,485 | B2 | 12/2012 | Waters | |
| 8,364,220 | B2 | 1/2013 | Sandmore | |
| 8,388,164 | B2 | 3/2013 | Waters | |
| 8,491,145 | B2 | 7/2013 | Waters | |
| 8,550,651 | B2 * | 10/2013 | Waters | 362/106 |
| 8,698,027 | B2 | 4/2014 | Anderst | |
| 8,757,931 | B2 | 6/2014 | Püttmann | |
| 8,769,723 | B1 | 7/2014 | Ilges | |
| 8,774,420 | B2 | 7/2014 | Belafonte et al. | |
| 8,813,268 | B1 | 8/2014 | Fitzgerald et al. | |
| 8,919,984 | B1 | 12/2014 | Fitzgerald | |
| 8,950,012 | B2 | 2/2015 | Ilges et al. | |
| 9,057,500 | B2 | 6/2015 | Opolka | |
| D734,925 | S | 7/2015 | Waters | |
| 2001/0024365 | A1 | 9/2001 | Aknine | |
| 2002/0027777 | A1 | 3/2002 | Takasu | |
| 2002/0129989 | A1 | 9/2002 | Parsons | |
| 2002/0131275 | A1 | 9/2002 | Yamamoto | |
| 2002/0159250 | A1 | 10/2002 | Kuo | |
| 2002/0163800 | A1 | 11/2002 | Hansen | |
| 2002/0186557 | A1 | 12/2002 | Lary | |
| 2002/0187806 | A1 | 12/2002 | Jang | |
| 2003/0079387 | A1 | 5/2003 | Derose | |
| 2003/0086053 | A1 | 5/2003 | Waters | |
| 2003/0086054 | A1 | 5/2003 | Waters | |
| 2003/0106918 | A1 | 6/2003 | Hung | |
| 2003/0122958 | A1 | 7/2003 | Olita | |
| 2003/0151910 | A1 | 8/2003 | Marston | |
| 2003/0169207 | A1 | 9/2003 | Beigel | |
| 2003/0189824 | A1 | 10/2003 | Meeder | |
| 2003/0206269 | A1 | 11/2003 | Waters | |
| 2003/0231489 | A1 | 12/2003 | Hsiao | |
| 2004/0001150 | A1 | 1/2004 | Schindler | |
| 2004/0008157 | A1 | 1/2004 | Brubaker | |
| 2004/0085745 | A1 | 5/2004 | Yoshihara | |
| 2004/0128737 | A1 | 7/2004 | Gesten | |
| 2004/0141312 | A1 | 7/2004 | Henning | |
| 2004/0141316 | A1 | 7/2004 | Twardawski | |
| 2004/0165109 | A1 | 8/2004 | Lee | |
| 2004/0222638 | A1 | 11/2004 | Bednyak | |
| 2004/0240067 | A1 | 12/2004 | Marusi | |
| 2004/0240204 | A1 | 12/2004 | Russ | |
| 2004/0264176 | A1 * | 12/2004 | Vanderschuit | 362/106 |
| 2005/0001433 | A1 | 1/2005 | Seelin | |
| 2005/0035925 | A1 | 2/2005 | Ostromek | |
| 2005/0047116 | A1 | 3/2005 | Gagne | |
| 2005/0066422 | A1 | 3/2005 | Yan | |
| 2005/0072458 | A1 | 4/2005 | Goldstein | |
| 2005/0078473 | A1 | 4/2005 | Zuloff | |
| 2005/0083676 | A1 | 4/2005 | VanderSchuit | |
| 2005/0099799 | A1 | 5/2005 | Cugini | |
| 2005/0105285 | A1 | 5/2005 | Maden | |
| 2005/0161313 | A1 | 7/2005 | Sorrentino | |
| 2005/0174753 | A1 | 8/2005 | Cao | |
| 2005/0204490 | A1 | 9/2005 | Kemp | |
| 2005/0211187 | A1 | 9/2005 | Harman | |
| 2005/0211574 | A1 | 9/2005 | Reeve | |
| 2005/0213340 | A1 | 9/2005 | Suzuki | |
| 2005/0219837 | A1 | 10/2005 | Brown | |
| 2005/0237479 | A1 | 10/2005 | Rose | |
| 2005/0248932 | A1 | 11/2005 | Waters | |
| 2005/0254238 | A1 | 11/2005 | Parker | |
| 2005/0265015 | A1 | 12/2005 | Salazar | |
| 2006/0012974 | A1 | 1/2006 | Su | |
| 2006/0012975 | A1 | 1/2006 | Huttner | |
| 2006/0037125 | A1 | 2/2006 | McDowell | |
| 2006/0091784 | A1 | 5/2006 | Conner | |
| 2006/0092621 | A1 | 5/2006 | Lai | |
| 2006/0093264 | A1 | 5/2006 | Tabuchi | |
| 2006/0107952 | A1 | 5/2006 | Schlosser | |
| 2006/0125624 | A1 | 6/2006 | Ostrovsky | |
| 2006/0126323 | A1 | 6/2006 | Pomes | |
| 2006/0138440 | A1 | 6/2006 | Jyo | |
| 2006/0141828 | A1 | 6/2006 | Dean | |
| 2006/0157569 | A1 | 7/2006 | Becker | |
| 2006/0158895 | A1 | 7/2006 | Brands | |
| 2006/0165160 | A1 | 7/2006 | Winningstad | |
| 2006/0198122 | A1 | 9/2006 | Senter | |
| 2006/0212994 | A1 | 9/2006 | Proctor | |
| 2006/0215393 | A1 | 9/2006 | VanderSchuit | |
| 2006/0232955 | A1 | 10/2006 | Labine | |
| 2006/0238995 | A1 | 10/2006 | Wang | |
| 2006/0239018 | A1 | 10/2006 | Jardin | |
| 2006/0263677 | A1 | 11/2006 | Tsai | |
| 2006/0285315 | A1 | 12/2006 | Tufenkjian | |
| 2006/0286443 | A1 | 12/2006 | Huang | |
| 2006/0291193 | A1 | 12/2006 | Hill | |
| 2007/0003826 | A1 | 1/2007 | Hsu | |
| 2007/0013865 | A1 | 1/2007 | Jordan | |
| 2007/0030442 | A1 | 2/2007 | Howell | |
| 2007/0048598 | A1 | 3/2007 | Huang | |
| 2007/0053179 | A1 | 3/2007 | Pang | |
| 2007/0058361 | A1 | 3/2007 | Sevilla | |
| 2007/0064413 | A1 | 3/2007 | Slater | |
| 2007/0072655 | A1 | 3/2007 | Cascone | |
| 2007/0074752 | A1 | 4/2007 | Shau | |
| 2007/0086182 | A1 | 4/2007 | Kelly | |
| 2007/0097668 | A1 | 5/2007 | Choi | |
| 2007/0127250 | A1 | 6/2007 | Waters | |
| 2007/0140675 | A1 | 6/2007 | Yanagi | |
| 2007/0145746 | A1 | 6/2007 | Biamonte | |
| 2007/0153500 | A1 | 7/2007 | Waters | |
| 2007/0153537 | A1 | 7/2007 | Scott | |
| 2007/0159810 | A1 | 7/2007 | Kim | |
| 2007/0159823 | A1 | 7/2007 | Ho | |
| 2007/0171628 | A1 | 7/2007 | Seade | |
| 2007/0189003 | A1 | 8/2007 | Daley | |
| 2007/0206373 | A1 | 9/2007 | Whiteside | |
| 2007/0236649 | A1 | 10/2007 | Lin | |
| 2007/0236915 | A1 | 10/2007 | Chen | |
| 2007/0236916 | A1 | 10/2007 | Hsu | |
| 2008/0049963 | A1 | 2/2008 | Mann et al. | |
| 2008/0069391 | A1 | 3/2008 | Steyn | |
| 2008/0130272 | A1 | 6/2008 | Waters | |
| 2008/0152482 | A1 | 6/2008 | Patel | |
| 2008/0186705 | A1 | 8/2008 | Liu | |
| 2008/0263750 | A1 | 10/2008 | Chen | |
| 2008/0266839 | A1 | 10/2008 | Claypool | |
| 2009/0010474 | A1 | 1/2009 | Ouryouji | |
| 2009/0126076 | A1 | 5/2009 | Ochoa | |
| 2009/0147503 | A1 | 6/2009 | Bennett | |
| 2009/0148149 | A1 | 6/2009 | Chishima | |
| 2009/0193566 | A1 | 8/2009 | Waters | |
| 2009/0213323 | A1 | 8/2009 | Mermanson | |
| 2009/0268936 | A1 | 10/2009 | Goldberg et al. | |
| 2009/0323317 | A1 | 12/2009 | Spartano | |
| 2010/0024091 | A1 | 2/2010 | Mehtab | |
| 2010/0095431 | A1 | 4/2010 | Liao | |
| 2010/0134761 | A1 | 6/2010 | Johns | |
| 2010/0182563 | A1 | 7/2010 | Waters | |
| 2010/0214767 | A1 | 8/2010 | Waters | |
| 2010/0242155 | A1 | 9/2010 | Carullo | |
| 2010/0307931 | A1 | 12/2010 | Waters | |
| 2010/0313335 | A1 | 12/2010 | Waters | |
| 2011/0013135 | A1 | 1/2011 | Waters | |
| 2011/0075095 | A1 | 3/2011 | Waters | |
| 2011/0122601 | A1 | 5/2011 | Waters | |
| 2011/0187989 | A1 | 8/2011 | Waters | |
| 2011/0210685 | A1 | 9/2011 | Liao | |
| 2011/0211156 | A1 | 9/2011 | Beiner | |
| 2011/0228211 | A1 | 9/2011 | Waters | |
| 2012/0014095 | A2 | 1/2012 | Waters | |
| 2012/0098465 | A1 | 4/2012 | Rothschild | |
| 2013/0025612 | A1 | 1/2013 | Hunter | |
| 2013/0111651 | A1 | 5/2013 | Waters | |
| 2013/0192961 | A1 | 8/2013 | Waters | |
| 2013/0198935 | A1 | 8/2013 | Waters | |
| 2014/0049947 | A1 | 2/2014 | Lombard | |
| 2014/0101827 | A1 | 4/2014 | Dennis | |
| 2014/0173807 | A1 | 6/2014 | Waters | |
| 2014/0237706 | A1 | 8/2014 | OConner | |

(56) References Cited

U.S. PATENT DOCUMENTS

| | | | |
|---|---|---|---|
| 2014/0268683 | A1 | 9/2014 | Waters |
| 2014/0270685 | A1 | 9/2014 | Letke |
| 2015/0358515 | A1 | 12/2015 | Resnick |

FOREIGN PATENT DOCUMENTS

| | | | |
|---|---|---|---|
| AU | 199940150 | | 2/2000 |
| AU | 199959545 | | 3/2000 |
| AU | 2002100976 | | 6/2003 |
| AU | 2003100277 | | 7/2003 |
| AU | 2003248016 | | 11/2004 |
| CA | 2029772 | | 5/1991 |
| CA | 2198625 | | 2/1997 |
| CA | 2184336 | | 5/1997 |
| CA | 2406450 | | 11/2001 |
| CA | 2466175 | A1 | 5/2003 |
| CA | 2608746 | A1 | 11/2006 |
| CA | 2610073 | A1 | 5/2008 |
| CN | 86208973 | | 10/1987 |
| CN | 2173427 | | 8/1994 |
| CN | 2239167 | | 11/1996 |
| CN | 2423761 | | 3/2001 |
| CN | 2433836 | | 6/2001 |
| CN | 2458892 | | 11/2001 |
| CN | 2508592 | | 9/2002 |
| CN | 2544551 | | 4/2003 |
| CN | 1462597 | | 12/2003 |
| CN | 1603677 | A | 4/2005 |
| CN | 101950091 | A | 1/2011 |
| CN | 301445845 | S | 1/2011 |
| DE | 3043007 | | 6/1982 |
| DE | 8230583 | | 9/1983 |
| DE | 9410886 | | 9/1994 |
| DE | 29808222 | | 11/1998 |
| DE | 19837151 | | 4/2000 |
| DE | 20007738 | | 9/2000 |
| DE | 29915607 | | 9/2000 |
| DE | 20017922 | | 2/2001 |
| DE | 20020515 | | 8/2001 |
| DE | 20101380 | | 8/2001 |
| DE | 20106261 | | 9/2001 |
| DE | 20111815 | | 11/2001 |
| DE | 10046295 | | 3/2002 |
| DE | 20117740 | | 4/2002 |
| DE | 20201557 | | 5/2002 |
| DE | 20200058 | | 6/2002 |
| DE | 10103591 | | 8/2002 |
| DE | 20110124 | | 8/2002 |
| DE | 10057388 | | 9/2002 |
| DE | 20209115 | | 10/2002 |
| DE | 20210806 | | 10/2002 |
| DE | 10216152 | | 12/2002 |
| DE | 20209611 | | 1/2003 |
| DE | 20313629 | | 12/2003 |
| DE | 10330589 | | 1/2004 |
| DE | 20319297 | | 2/2004 |
| DE | 20318860 | | 4/2004 |
| DE | 20318949 | | 4/2004 |
| DE | 202004004960 | | 9/2005 |
| DE | 102007006860 | A1 | 8/2007 |
| EP | 1072204 | | 1/2001 |
| EP | 1374707 | | 1/2004 |
| EP | 2290433 | A1 | 3/2011 |
| EP | 2299311 | A1 | 3/2011 |
| FR | 1221782 | | 6/1960 |
| FR | 2798721 | | 3/2001 |
| FR | 2824709 | | 11/2002 |
| FR | 2829365 | | 3/2003 |
| FR | 2833068 | | 6/2003 |
| FR | 2833069 | | 6/2003 |
| GB | 2268043 | | 1/1994 |
| GB | 2272073 | A | 5/1994 |
| GB | 2316293 | | 2/1998 |
| GB | 2358575 | | 8/2001 |
| GB | 2363314 | | 12/2001 |
| GB | 2374401 | | 10/2002 |
| GB | 2378117 | | 2/2003 |
| GB | 2378118 | | 2/2003 |
| GB | 2388298 | | 11/2003 |
| JP | S61006304 | | 1/1986 |
| JP | 4289602 | | 10/1992 |
| JP | H08027610 | A | 1/1996 |
| JP | H08298004 | A | 11/1996 |
| JP | H09209210 | A | 8/1997 |
| JP | H09296319 | A | 11/1997 |
| JP | H10081275 | A | 3/1998 |
| JP | H10331019 | A | 12/1998 |
| JP | 2001131818 | A | 5/2001 |
| JP | 3084061 | | 11/2001 |
| JP | 3090973 | | 10/2002 |
| JP | 2004207580 | | 7/2004 |
| JP | 2004346470 | | 12/2004 |
| JP | 2005216832 | A | 8/2005 |
| JP | 2006097156 | A | 4/2006 |
| JP | 2007119980 | | 5/2007 |
| JP | 2008542558 | | 11/2008 |
| KR | 200164075 | | 2/2000 |
| KR | 200168822 | Y1 | 2/2000 |
| KR | 200168826 | | 2/2000 |
| KR | 200260980 | | 1/2002 |
| KR | 20020065405 | | 8/2002 |
| KR | 200331201 | | 10/2003 |
| TW | 241462 | | 2/1995 |
| TW | 275188 | | 5/1996 |
| TW | 286489 | | 9/1996 |
| TW | 324234 | | 1/1998 |
| TW | 329607 | | 4/1998 |
| TW | 386364 | | 4/2000 |
| WO | 9402043 | | 2/1994 |
| WO | 9704434 | | 2/1997 |
| WO | 0113033 | A1 | 2/2001 |
| WO | 0177575 | A1 | 10/2001 |
| WO | 0244611 | | 6/2002 |
| WO | 02062165 | | 8/2002 |
| WO | 02074398 | | 9/2002 |
| WO | 02077520 | | 10/2002 |
| WO | 03040808 | A2 | 5/2003 |
| WO | 03047377 | | 6/2003 |
| WO | 03083811 | | 10/2003 |
| WO | 04000054 | | 12/2003 |
| WO | 2004064555 | | 5/2004 |
| WO | 2004103104 | | 12/2004 |
| WO | 2005002378 | | 1/2005 |
| WO | 2005005882 | | 1/2005 |
| WO | 2005038337 | | 4/2005 |
| WO | 2005096856 | | 10/2005 |
| WO | 2005098314 | | 10/2005 |
| WO | 2006037845 | | 4/2006 |
| WO | 2006124928 | | 11/2006 |
| WO | 2007073047 | | 6/2007 |
| WO | 2007073219 | | 6/2007 |
| WO | 2007089236 | | 8/2007 |
| WO | 2007093348 | | 8/2007 |
| WO | 2007112338 | | 10/2007 |
| WO | 2008011750 | | 1/2008 |
| WO | 2009079656 | A2 | 6/2009 |
| WO | 2010099504 | | 9/2010 |
| WO | 2011041591 | A1 | 4/2011 |
| WO | 2011100471 | A1 | 8/2011 |
| WO | 2011137400 | | 11/2011 |
| WO | 2011137406 | | 11/2011 |
| WO | 2013096895 | | 6/2013 |
| WO | 2013096904 | | 6/2013 |
| ZA | 20043826 | A | 9/2005 |

OTHER PUBLICATIONS

'Waters Industries' Answer to Defendant's Amended Counterclaims', *Waters Industries, Inc.* v. *Outdoor Cap Co., Inc.*, United States District Court for the Northern District of Illinois, Case No. 1:13-cv-07191, 12 pages (Document No. 38, Dec. 18, 2013).

"Answer to Complaint, Counterclaims", filed by Sweet Baby, Inc. dba AJ Morgan, *Waters Industries, Inc.* v. *Sweet Baby, Inc. dba AJ*

(56) References Cited

OTHER PUBLICATIONS

*Morgan et al.*, United States District Court for the Northern District of Illinois, Case No. 1:09-cv-07595, 15 pages (Docket No. 27, Feb. 4, 2010).
"Complaint", *Waters Industries, Inc.* v. *Kikkerland Design, Inc.*, United States District Court for the Northern District of Illinois, Case No. 1:10-cv-04076, 21 pages (Docket No. 1, Jun. 30, 2010).
"Complaint", *Waters Industries, Inc.* v. *Mr. Christmas Incorporated, et al.*, United States District Court for the Northern District of Illinois, Case No. 1:09-cv-07577, 38 pages (Docket No. 1, Dec. 7, 2009).
"Complaint", *Waters Industries, Inc.* v. *Sweet Baby, Inc. dba AJ Morgan et al.*, United States District Court for the Northern District of Illinois, Case No. 1:09-cv-07595, 78 pages (Docket No. 1, Dec. 7, 2009).
"Complaint", *Waters Industries, Inc.* v. *The Gerson Company*, United States District Court for the Northern District of Illinois, Case No. 1:10-cv-01865,71 pages (Docket No. 1, Mar. 24, 2010).
"Complaint" with Exhibit A through D, *Waters Industries, Inc.* v. *JJI International, Inc., et al.*, United States District Court for the Northern District of Illinois, Case No. 1:11-cv-03791, 73 pages (Document No. 1, Jun. 3, 2011).
"Defendants' Answer and Counterclaim" and "Responses to Specific Allegations", *Waters Industries, Inc.* v. *JJI International, Inc. and Stein Mart, Inc.*, United States District Court for the Northern District of Illinois, Case No. 1:11-cv-03791, 16 pages (Document No. 15, Jun. 28, 2011).
"Defendants' Initial Non-Infringement and Invalidity Contentions" with Appendix A though G, *Waters Industries, Inc.* v. *JJI International, Inc. and Stein Mart, Inc.*, United States District Court for the Northern District of Illinois, Case No. 1:11-cv-03791, 78 pages (Aug. 9, 2011).
"Kikkerland Design, Inc.'s Answer to Complaint, Affirmative Defenses and Counterclaim", *Waters Industries, Inc.*v. *Kikkerland Design, Inc.*,United States District Court for the Northern District of Illinois, Case No. 1:10-cv-04076, 12 pages (Docket No. 17, Aug. 6, 2010).
"Plaintiff's Initial Infringement Contentions Under Local Patent Rule 2.2" with Appendix A through F,*Waters Industries, Inc.* v. *JJI International, Inc. and Stein Mart, Inc.*, United States District Court for the Northern District of Illinois, Case No. 1:11-cv-03791, 44 pages (Jul. 26, 2011).
"Plaintiffs Initial Response to Invalidity Contentions Under Local Patent Rule 2.5" with Appendix A and B, *Waters Industries, Inc.* v. *JJI International, Inc. and Stein Mart, Inc.*, United States District Court for the Northern District of Illinois, Case No. 1:11-cv-03791, 29 pages (Aug. 23, 2011).
Docket report of *Waters Industries, Inc.* v. *Kikkerland Design, Inc.*, United States District Court for the Northern District of Illinois, Case No. 1:10-cv-04076, filed Jun. 30, 2010, 4 pages.
Docket report of *Waters Industries, Inc.* v. *Mr. Christmas Incorporated, et al.*, United States District Court for the Northern District of Illinois, Case No. 1:09-cv-07577, filed Dec. 7, 2009, 5 pages.
Docket report of *Waters Industries, Inc.* v. *Outdoor Cap Co., Inc.*, United States District Court for the Northern District of Oklahoma, Case No. 4:13-cv-00665-CVE-FHM, filed Oct. 8, 2013 (7 pages).
Docket report of *Waters Industries, Inc.* v. *Sweet Baby, Inc. dba AJ Morgan et al.*, United States District Court for the Northern District of Illinois, Case No. 1:09-cv-07595, filed Dec. 7, 2009, 7 pages.
Docket report of *Waters Industries, Inc.* v. *The Gerson Company*, United States District Court for the Northern District of Illinois, Case No. 1:10-cv-01865, filed Mar. 24, 2010, 3 pages.
Docket report of *Waters Industries, Inc.* v. *Totes Isotoner Corporation, et al.*, United States District Court for the Northern District of Illinois, Case No. 1:10-cv-04487 filed Jul. 19, 2010 (4 pages).
Extended European search report issued in the related European Application No. 08 86 2753.4 dated Dec. 7, 2012 (7 pages).
Extended European search report issued in the related European Application No. 10 18 1592.6 dated Jan. 31, 2011 (7 pages).
Extended European search report issued in the related European Application No. 10 18 1593.4 dated Feb. 1, 2011 (8 pages).
International Search Report from the International Bureau of WIPO issued in the related International Application No. PCT/US02/35665, dated Jun. 27, 2003, 1 page.
Notification Concerning Transmittal of International Preliminary Report on Patentability and the Written Opinion of the International Searching Authority from the International Bureau of WIPO for International Application No. PCT/US2013/076689, dated Jul. 2, 2015, 7 pages.
Notification of Transmittal of the International Search Report and the Written Opinion of the International Searching Authority, or the Declaration from the International Bureau of WIPO for International Application No. PCT/US10/50978, dated Dec. 3, 2010, 16 pages.
Notification of Transmittal of the International Search Report and the Written Opinion of the International Searching Authority, or the Declaration from the International Bureau of WIPO for International Application No. PCT/US14/28613, 13 pages.
Notification of Transmittal of the International Search Report and the Written Opinion of the International Searching Authority, or the Declaration from the International Bureau of WIPO for International Application No. PCT/US2008/087542 dated May 4, 2009, 12 pages.
Notification of Transmittal of the International Search Report and the Written Opinion of the International Searching Authority, or the Declaration from the International Bureau of WIPO for International Application No. PCT/US2010/025689 dated May 4, 2010, 14 pages.
Notification of Transmittal of the International Search Report and the Written Opinion of the International Searching Authority, or the Declaration from the International Bureau of WIPO for International Application No. PCT/US2011/024400, dated Apr. 29, 2011, 13 pages.
Notification of Transmittal of the International Search Report and the Written Opinion of the International Searching Authority, or the Declaration from the International Bureau of WIPO for International Application No. PCT/US2011/034686 dated Aug. 1, 2011, 16 pages.
Notification of Transmittal of the International Search Report and the Written Opinion of the International Searching Authority, or the Declaration from the International Bureau of WIPO for International Application No. PCT/US2011/051596, dated Jan. 18, 2012, 9 pages.
Notification of Transmittal of the International Search Report and the Written Opinion of the International Searching Authority, or the Declaration from the International Bureau of WIPO for related International Application No. PCT/US2011/034695 dated Oct. 28, 2011, 12 pages.
Office Action issued in related Canadian Application No. 2,466,175 dated Sep. 22, 2010 (3 pages).
Office Action issued in related European Application No. 02 778 755.5 dated Feb. 20, 2007 (7 pages).
Office Action issued in related Japanese Application No. 2010-539834 dated Mar. 19, 2013 and English translation of the same (10 pages).
Patent Examination Report issued in related Australian Application No. 2008338320 dated Nov. 1, 2012 (5 pages).
Supplementary European search report issued in the related European Application No. 02 77 8755 dated Jan. 19, 2005 (2 pages).
Written Opinion of the International Searching Authority and International Search Report from the International Bureau of WIPO for International Application No. PCT/US2006/018968, dated Oct. 16, 2006, 12 pages.
Written Opinion of the International Searching Authority and International Search Report from the International Bureau of WIPO for International Application No. PCT/US2006/018968, dated Oct. 16, 2006, 7 pages.
Written Opinion of the International Searching Authority and International Search Report from the International Bureau of WIPO for International Application No. PCT/US2008/087542, dated May 4, 2009, 8 pages.

(56) References Cited

OTHER PUBLICATIONS

"Answer and Counterclaim of Defendant Outdoor Cap Co., Inc.," *Waters Industries, Inc.* v. *Outdoor Cap Co., Inc.*, United States District Court for the Northern District of Illinois, Case No. 1:13-cv-07191, 11 pages. (Document No. 13, Oct. 30, 2013).
"Complaint", *Waters Industries, Inc.* v. *Totes Isotoner Corporation, et al.*, United States District Court for the Northern District of Illinois, Case No. 1:10-cv-04487 (Docket No. 1, Jul. 19, 2010) (26 pages).
"Declaratory Judgment Complaint" with Exhibit A and Exhibit B, *Waters Industries, Inc.* v. *Outdoor Cap Co., Inc.*, United States District Court for the Northern District of Illinois, Case No. 4:13-cv-00665-CVE-FHM, 52 pages (Document No. 2, Oct. 8, 2013).
"First Amended Answer and Counterclaim of Defendant Outdoor Cap Co., Inc." with Exhibit A through G, *Waters Industries, Inc.* v. *Outdoor Cap Co., Inc.*, United States District Court for the Northern District of Illinois, Case No. 1:13-cv-07191, 201 pages (Document No. 34, Dec. 11, 2013).
"Plaintiff's Complaint" with Exhibit A, *Waters Industries, Inc.* v. *Outdoor Cap Co., Inc.*, United States District Court for the Northern District of Illinois, Case No. 1:13-cv-07191, 7 pages (Document No. 1, Oct. 8, 2013).
"Plaintiff's First Amended Complaint" with Exhibit A and Exhibit B, *Waters Industries, Inc.* v. *Outdoor Cap Co., Inc.*, United States District Court for the Northern District of Illinois, Case No. 4:13-cv-00665-CVE-FHM, 51 pages (Document No. 11, Oct. 10, 2013).
"Plaintiff's Initial Infringement Contentions Under Local Patent Rule 2.2" with Appendix A, Figures 1-5, and Exhibits 1-3, *Waters Industries, Inc.* v. *Outdoor Cap Co., Inc.*, United States District Court for the Northern District of Illinois, Case No. 1 :13-cv-07191, 58 pages (Nov. 27, 2013).
"Waters Industries' Answer to Defendant's Counterclaims," *Waters Industries, Inc.* v. *Outdoor Cap Co., Inc.*, United States District Court for the Northern District of Illinois, Case No. 1:13-cv-07191, 5 pages (Document No. 28, Nov. 20, 2013).
Notification of Transmittal of the International Search Report and the Written Opinion of the International Searching Authority, or the Declaration from the International Bureau of WIPO for International Application No. PCT/ US2014/028945 dated Jul. 31, 2014, 9 pages.

* cited by examiner

LIGHTED HAT

CROSS-REFERENCE TO RELATED APPLICATIONS

This application is a continuation of U.S. patent application Ser. No. 12/714,403, filed Feb. 26, 2010, which claims benefit of U.S. Provisional Application No. 61/156,464 filed Feb. 27, 2009; and is also a continuation-in-part of International Application Number PCT/US08/87542, filed Dec. 18, 2008, which claims benefit of U.S. Provisional Application No. 61/014,726, filed Dec. 18, 2007, which are all hereby incorporated herein by reference in their entirety.

FIELD OF THE INVENTION

The field relates to hands-free lighting devices and, in particular, to lighted hats capable of providing illumination for a wearer.

BACKGROUND OF THE INVENTION

Often an individual desires a light focused to illuminate an area while performing a task or a light directed in a general forwardly direction along their line of sight for visibility. Holding a flashlight is an option, but such lighting devices are often cumbersome and may detract from the task being completed because only one hand is available for the task since the other hand is holding the flashlight. As a result, hands-free lighting is desirable so that both hands are available for performing a task in lighted conditions.

Headgear is known that may include light sources attached so as to illuminate an area within the wearer's line of vision. The light source may be an LED mounted to a brim portion of a baseball style hat. Generally, these hats have the LED mounted to direct light forwardly from the brim so that the LED axis is parallel with the fore-and-aft brim axis. With these hats if a wearer wishes to illuminate an object located at a specific location from the wearer, the wearer must move his entire head or hat to direct the brim and light emitted therefrom toward the particular object. If the object is located far away, then the wearer may direct the illumination by moving the hat so that the brim extends generally horizontally or parallel to the ground to provide a beam of light to illuminate the far off object or area. If the object is located nearby, close to, and below the wearer's face, then the wearer must move the hat brim downward to a declined position such that the hat provides a beam of light to illuminate the closer object. Oftentimes, moving the hat downward will require the wearer to bend his neck. This motion may be undesirable because it may be uncomfortable for some people.

For example, U.S. Pat. No. 5,741,060 to Johnson discloses a lighted hat with two lamps connected to a mounting plate secured to the outside lower surface of a brim of the hat. The light sources are both fixed so that they project light forwardly. If the wearer wishes to adjust the illumination to be directed in another direction, the wearer must still tilt his head or the hat itself in an upward, downward, left or right direction. These lamps also hang noticeably below the visor portion and include relatively large sockets which are soldered to the mounting plate. Both the mounting plate and the sockets are externally attached to the bottom of the visor portion and are readily visible to a third party viewer thereby creating an unaesthetic and non-natural appearance. The external arrangement of these large and bulky lamps and sockets also may be within the peripheral vision of the wearer, which may be distracting, and/or may even block or interfere with a wearer's vision. Furthermore, since these lamps are fixed, illumination is only available in the generally forward direction of the hat wearer.

In another example, U.S. Pat. No. 6,056,413 to Urso discloses a light connected to a visor of a baseball-style cap. The light of Urso is a light bulb received in a socket with the light being pivotally connected to the underside of the visor. The pivotal mounting allows the light to be pivoted in a downward or upward direction to provide light to a location the wearer chooses to illuminate. This configuration permits a wearer to focus the light in a forward direction to provide illumination directly in front of the wearer or rotate the light source in a downward direction to provide illumination at a location below the visor. Pivoting lights are undesirable as they introduce complexity and moving parts into the hat that can fail over repeated usage. While the light of Urso pivots, it still can only project light to one location or area at any one time. Similar to the hat of Johnson, the light of Urso is also bulky and hangs noticeably below the visor. The large profile of this light and mounting apparatus may similarly block or interfere with a wearer's vision as well as create an unaesthetic appearance to third parties viewing the lighted hat, especially when the light is pivoted downwardly. Furthermore, Urso mounts a power source and switch in a crown portion of the hat with wiring extending therebetween across a pivot joint of the light source. Over time, it is possible that the wiring extending across the pivot joint may fail due to repeated bending as the light is pivoted up and down.

In another example, U.S. Pat. No. 6,994,445 to Pomes describes a baseball cap having a light source inside a brim portion of the hat. In one embodiment, the light source is mounted within a recess compartment of the brim so as to be oriented in a horizontal or parallel position relative to the fore-and-aft axis of the brim. A reflector is positioned in the compartment to reflect the light provided by the light source in a downward direction below the brim. Requiring the beam of illumination to be reflected only provides indirect illumination that is less precise and more difficult to control and direct than a beam of illumination directly emanating from a light source. In another example, Pomes discloses a light source that is mounted vertically orthogonal to the brim's fore-and-aft axis within the recess so that the light source is pointed in a downward direction relative to the brim. To allow the light source to fit in the brim in this vertical orientation, Pomes teaches that the brim can have a thickened section to make space for receiving the light source. Since Pomes describes a light source mounted in a vertical orientation but still enclosed within the brim location, the profile of the brim may be thicker than desired so as not to have the typical streamlined and thin appearance of a traditional baseball hat. Moreover, the perpendicular orientation of the light source relative to the brim is likely to provide illumination in a downward direction that only illuminates an area directly underneath the visor. Neither configuration of Pomes is ideal for illuminating objects that may be located at a reading or viewing distance in front of the wearer. Moreover, projecting light directly underneath the visor as in Pomes can also cause glare or project light into the wearer's eyes.

SUMMARY OF THE INVENTION

In one aspect, lighted headgear is disclosed where a plurality of light sources are mounted to the headgear for providing outward illumination to at least two different areas or in at least two different directions from the headgear. In one form, the light sources are mounted to a brim of the headgear and oriented to provide outward illumination at different angles relative to each other. One light source can be one or more LEDs mounted to direct illumination forwardly of the brim and provide a beam of illumination to areas that are located at distances that are relatively far away from the hat. Another light source can be one or more LEDs mounted to the brim and oriented to direct a beam of illumination at a downward and transverse angle to the first beam of illumination thereby providing illumination to an area located more closely to the hat. Such lighted hats advantageously allow a wearer to illuminate areas at close working distances, such as at a reading distance in front of the wearer, or to areas at distances much farther away from the wearer at the same time and without the need of the hat wearer moving the hat or pivoting the light sources.

In another form, a light holder for being mounted to headgear as well as headgear with the light holder mounted thereto is disclosed. The light holder may be mounted to the brim of the headgear for fixing the light sources in a particular orientation. In one aspect, the light holder includes a mounting base and one or more light holding bezels or modules that extend in a downward and oblique angle of inclination away from the base. The holder portions or bezels are sized to receive the light sources and, in one approach, maintain multiple light sources at the same fixed oblique angle of inclination relative to the base. Thus, the light holder advantageously allows multiple light sources to be secured to headgear in a quick and easy manner where more than one light source are oriented in the same direction to provide illumination in a downward direction of inclination. In another aspect, the light module is relatively thin and compact. This allows the light holder to remain largely undetectable thereby allowing the hat to maintain a streamlined and natural appearance in contrast to the prior hats of Johnson, Urso, and Pomes that require bulky modules on the outside of the brim or a thick brim to house a recess large enough to hold a light source therein. In this regard, the low profile of the light holder allows it to be mounted either interiorly of brim structure such as between the brim insert and fabric cover or exteriorly to the fabric cover without detracting from the functionality or appearance of the headgear In one form, the light holder is attached to the lighted hat via a mounting patch portion or other mounting surface located on the headgear brim, such as along a portion of the covering material extending about the brim. Thus, by one approach, the light holder and the lights thereof, are secured to the mounting patch formed on the brim covering material rather than to the shape retentive insert of the brim. This mounting patch preferably has a thickness thereof that is greater than the thickness of the brim covering material to form a secure and preferably more rigid or stiffer mounting location for the light holder than the thinner brim covering material. The light holder is preferably secured to the covering material with adhesive, and the mounting patch advantageously maintains the outer surface of the brim covering material free of residual adhesive, which may otherwise tend to seep though the thinner covering material, such as fabric, commonly used for hat brims. In this manner, the mounting patch keeps blemishes or stains from forming on outer surfaces on the brim covering material by blocking adhesive from wicking and/or seeping through the brim covering material. In one example, the mounting patch may be of a non-wicking material that keeps the adhesive from seeping through the brim covering material. In another example, the mounting patch may be a thick layer of material that blocks the adhesive from leaking through the brim covering material. For instance, the mounting patch can be embroidered stitching which can be of non-wicking material and be sewn so as to extend through the brim fabric covering material to be thicker than the fabric covering material. To this end, the embroidered stitching provides the additional benefit of providing an excellent location for including indicia such as logos, brand names, etc. for promotional purposes that can be sewn therein.

DETAILED DESCRIPTION OF THE PREFERRED EMBODIMENTS

Figure 1:
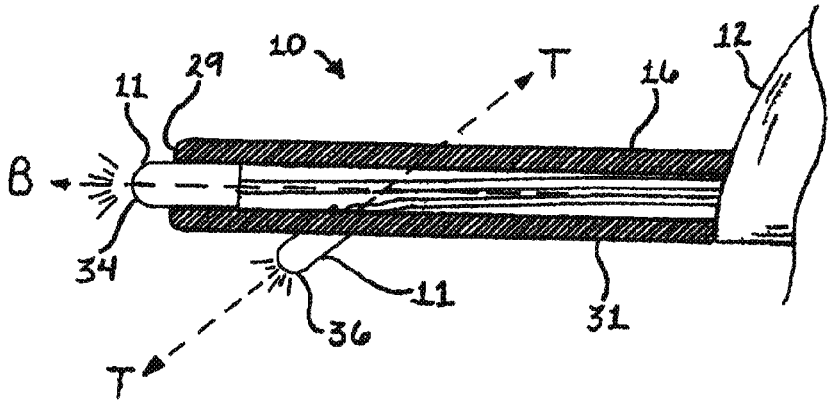
FIG. 1 is a side sectional view of the brim of a lighted hat having an LED mounted thereto to project a beam of light in a forward direction and an LED mounted thereto to provide illumination in a downward direction.

In general, the various aspects described herein relate to hands-free lighting, components thereof, and other accessories therefor. As further described below, the hands-free lighting may include lighted headgear such as hats, including baseball caps, hoods, visors, military or law enforcement helmets or headgear, bike helmets, or other lighted headgear having the lights positioned thereon to provide lighting in a forward and/or downward direction from the wearer.

In one aspect, the hands-free lighting is able to simultaneously provide illumination in multiple directions while maintaining a natural, streamlined configuration associated with traditional headgear. Multiple light sources may be positioned on a brim of the lighted headgear to project a beam of light in at least two different directions, thereby allowing a wearer to illuminate different areas, such as areas at different distances from the wearer, without the wearer needing to tilt or rotate his head. In another aspect, light sources may be mounted to a light holder or mounting member that is attached to the brim to provide illumination in different directions, while still allowing the brim of the headgear to maintain a low profile so as to have a thin and natural appearance. In one form, the light holder is advantageous because it provides an easy and convenient way to mount more than one light source canted in the same direction relative to the brim. In yet another aspect, the lighted hat may include a relatively thicker mounting portion or patch positioned on the brim to provide a more secure mounting location or surface for the light holder. In one example, the light holder may be attached to an inside surface of the brim via the mounting portion using adhesive, sewing, stitching, ultrasonic welding, Velcro, or other suitable fastening techniques so that the light holder is substantially concealed within the brim. In another example, the light holder is attached to the mounting portion on the inside of a covering material extending about the brim with adhesive, and the mounting portion functions as a barrier to minimize and, preferably, avoid leaking or seeping of the adhesive from passing through the covering material of the brim. The mounting portion, therefore, helps minimizes the appearance of residual adhesive on the outer surface of the brim covering, which can otherwise form an unsightly stain or other mark. Additional details are described below with reference to a baseball cap, but it will be appreciated this is only an example of one particular application. The hands-free lighting described herein may be incorporated in other types of headgear as well.

In general, the lighted hat and other headgear described herein include illumination sources, which are preferably LEDs, mounted at different locations on the hat. To energize these illumination sources, a variety of different power assemblies can also be used that employ varying mechanisms to generate energy. For instance, as disclosed in Applicant's U.S. application Ser. No. 11/941,558, which is incorporated herein by reference in its entirety, the mechanisms to generate energy may include power generators that use renewable energy, such as solar, wind, or kinetic energy, or various battery configurations in order to generate electrical power that ultimately energizes the variety of light sources that may be included on the described hats. For example, a laminate capacitor can be formed by the brim structure with outer layers of fabric being saturated with carbon nanotubes while the middle fabric layer is untreated. The two outer layers can be charged such as via a conventional power source or by a solar cell panel in the hat or brim portion thereof. While the following description and illustrations may describe a conventional battery power source, renewable power generators as described in the '558 application may also be included in the hat embodiments. In some instances, it may be desirable to include a charging port 805 in the hat such as along the outer edge of the brim. In addition, while the preferred headgear is a baseball-type hat or cap, the power assemblies and illumination sources may also be mounted to any suitable headgear, such as visors, helmets, headbands, hoods, or the like.

Figure 2:
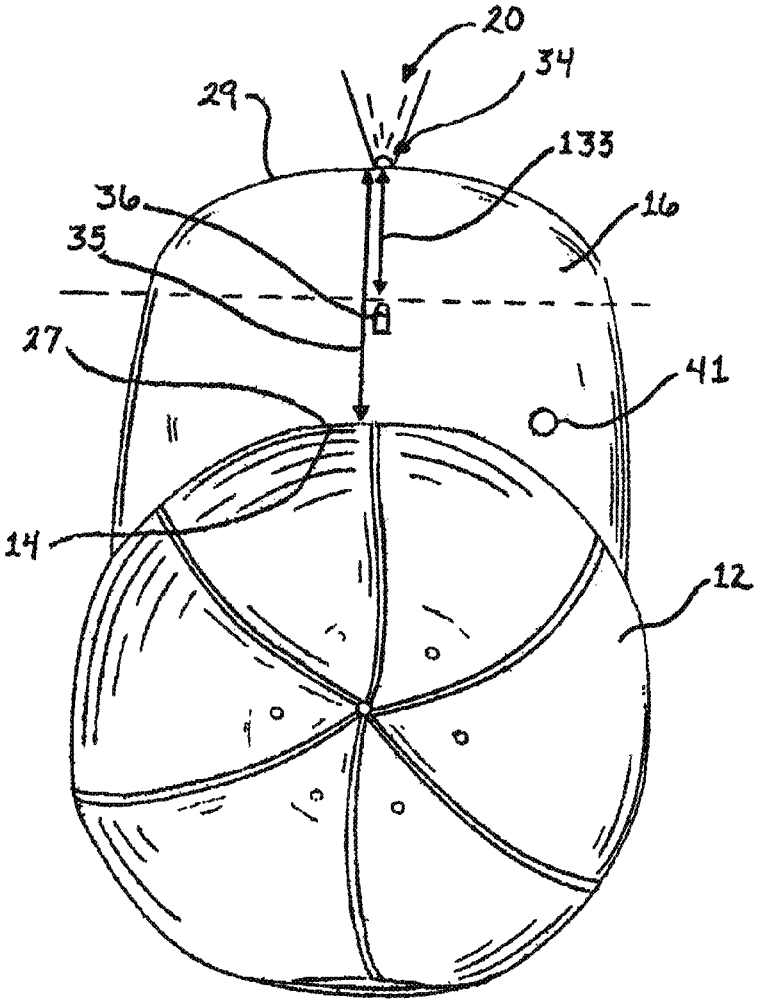
FIG. 2 is a bottom plan view of a brim of a lighted hat having an LED along the perimeter edge of the brim and an LED underneath the brim at an intermediate position along the fore-and-aft axis.
Figure 3:
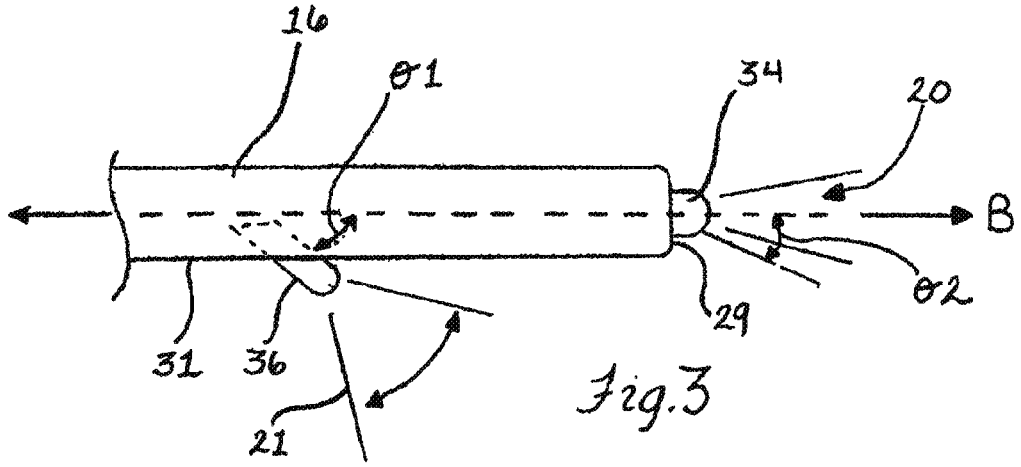
FIG. 3 is a fragmentary side view of the brim of FIG. 2 showing the LED positioned at the perimeter edge of the brim providing illumination in a forward direction and the LED positioned underneath the brim at the intermediate position being canted at a downward angle relative to the brim.

A first embodiment of hands-free lighting 10 having a light source 11 configured to direct light in multiple directions is generally illustrated in FIGS. 1-3. In this embodiment, the light source 11 may be mounted to a lighted hat and, in particular, to a brim portion 16 of the light hat. FIGS. 1-3 illustrate the brim portion 16 generally without an associated head or crown portion 12, but it will be appreciated that any common crown or other head fitting portion that does not cover the wearer's head such as with visors may be employed. Referring to FIG. 1, the light source 11 includes a plurality of light sources 34 and 36, preferably LEDs, to provide illumination in multiple directions. In this embodiment, the brim 16 of the lighted hat generally extends in a fore-and-aft direction along a brim axis B, and the lighted hat 10 has the light source 34 positioned to direct light generally along the brim axis B and the light source 36 mounted on the brim 16 and configured to direct light inclined relative to the brim axis B along an axis T that extends downward from and transverse or obliquely to the brim axis B.

By one approach, the light sources 34 and 36 are configured to illuminate objects in areas that are different distances away from the hat. For example, the light source 34 may be configured to emit light along the brim axis B to illuminate an object or a location at a distance relatively far away from the wearer, such as approximately four to approximately six feet from the wearer. The light source 36 may be configured to emit light at an angle to the brim axis B along the axis T to illuminate an object or a location at a distance closer to the wearer, such as at a reading distance of approximately 3 inches to approximately 30 inches. These two areas are illuminated without requiring the wearer to shift his head in any given direction. That is, this configuration allows multiple distances to be illuminated simultaneously or at alternating times to thereby allow a wearer to see both objects at a distance and objects at a closer distance, without requiring shifting of the hat, just the shifting of the wearer's eyes. This configuration can be valuable in the field of military or law enforcement, for example. The positioning of the light source 36 underneath the brim is substantially concealed below the brim, which provides a beam of illumination whose source of light is not as easily seen by a third party viewer.

Turning to more of the specifics, the forward light source 34 is mounted at or adjacent a perimeter edge 29 of the brim 16, and preferably along the centerline of the brim 16, as shown in FIG. 2. The light source 34 may be a high-beam light source, which may include a relatively narrow cone of light 20, having an approximately 15 degree to approximately 20 degree light cone for projecting illumination relatively far distances from the wearer. The second light source 36 may be a low beam or look down light source and be mounted to the hat brim 16 remote from the perimeter edge 29, such as on a lower major surface 31 of the brim 16 as best shown in FIGS. 1 and 3. To this end, the light source 36 may be mounted at the lower major surface 31 of the hat brim 16 and spaced intermediately between a forwardmost portion of the perimeter edge 29 and the lower forward edge portion of a head fitting portion of the headgear or the crown 14, such as a distance 33 approximately halfway, and preferably more than half the fore-and-aft distance 35 between the front edge 29 and a rear edge 27 of the hat brim 16, as shown in FIG. 2. This positioning of the light source 36 is advantageous because it directs light within a lower viewing field of the wearer to provide illumination to a reading or working distance but at the same time avoids directing light towards others who are near the hat wearer, which can disadvantageously shine into other's eyes. Moreover, this positioning of the light 36 can provide illumination while substantially concealing the source of light from a third party viewer as mentioned above.

By one approach and referring to FIG. 3, the low beam light source 36 mounted at the lower surface 31 of the brim 16 is canted at an angle θ1 relative to the brim axis B extending through the hat brim 16 so that the light cone 21 therefrom is directed downwardly and forwardly of the hat brim 16 to illuminate an area relatively close to the hat brim 116. The cant angle θ1 can vary such as between about 15 degrees to about 40 degrees and can be selected based upon the configuration of the hat and its intended use. In an example where the light source 36 is used for reading, the cant angle θ1 can be about 30 degrees. In another example where the light source 36 is used for running, the cant angle θ1 can be about 20 degrees so the light is directed out more forwardly of the user so they can see the path on which they are running. In yet another example, the cant angle θ1 may preferably be 25 degrees to provide a medium range distance. With respect to the LED power, the light source 36 is preferably a 10,000 MCD or higher powered light emitting diode, although other LED outputs may be acceptable. The light source 36 may have about a 20 degree to about a 40 degree light cone 21 to provide a wider and less focused beam of light than the narrower light cone 20 of the light source 34. By mounting the light source 36 away from the brim perimeter edge 29 to be spaced therefrom and canting the light downwardly and forwardly, the direction of the light beam 21 does not shine in the direction of other third party viewers near the person wearing the light hat and also directs light and glare away from the wearer's eyes.

The light source 34 is preferably positioned to extend from the perimeter edge 29 of the hat brim 16 to direct light forwardly of the wearer. By one approach, the light source 34 may also be slightly canted relative to the brim axis B at a cant angle θ2, but is canted over a smaller angle θ2 than the light 36. For example, the light 34 may be canted from 0 to about 15 degrees downwardly from the axis B, and more preferably, about 5 to about 15 degrees. In order to project light farther distances, the light 34 may be a 20,000 MCD light emitting diode having about a 15 to about a 20 degree light cone.

Preferably, the light sources 34 and 36 are spaced from each other by being mounted on different portions of the hat brim 16. For example and as mentioned above, the light source 34 is mounted to extend from the brim's outer perimeter edge 29, and the light source 36 is mounted to extend downwardly from the major surface 31 forming the brim's lower surface or underside. As a result of this configuration and positioning of the lights 34 and 36, the light cone 21 and the light cone 20 preferably do not intersect or overlap each other and provide separate, discrete cones of illumination for differing purposes (e.g., far illumination and close illumination). When both lights 34 and 36 are energized, the wearer will not need to redirect their head to focus light on close and far objects. The wearer simply needs to move their eyes without significant head movement as the hat already directs illumination in two different directions and orientations. Of course, the lights 34 and 36 can be energized together or separately as needed for particular situations. In other examples, it might be desirable to have a low beam light source 36 positioned closer to the beam of illumination 20 provided by the high beam LED 34 to provide some overlap in the light beams 20 and 21 at a distance spaced outwardly from the brim. In other situations, it may also be desirable to have the low beam LED 36 provide a beam of illumination at a smaller cant angle where the low beam light source 36 positioned underneath the brim 16 might have a beam of illumination 21 partially blocked by the underside of the brim 16 due to the small cant angle.

Referring again to FIG. 2, this form of the lighted hat 10 may also include a single or multi-function switch 41 positioned on the lower brim surface 31. In one aspect, the switch 41 may be a multi-position switch that includes one or more positions or modes, such as at least a 4-position switch to select varying modes of illumination. For example, the switch 41 can select either one of the high beam or low beam illumination or both at the same time, vary intensity of one or both light sources 34 and 36, vary color, and the like. The switch 41 may be a pushbutton switch, a slide switch, a rotary switch, or the like. The switch 41 can be located on the underside of the brim 16 as shown in FIG. 2 or may be located at the brim perimeter edge 29.

For energizing the light source, the lighted hat may include at least one, and preferably two battery packs mounted to the hat. In one configuration, both battery packs are electrically connected to both the low beam and high beam lights, but in another configuration, one battery pack is electrically connected to the low beam lights and the other battery pack is electrically connected to the high beam lights. In this situation, the battery configuration can be optimized for each set of lights. For instance, additional battery power can be provided for either the low or high beam lights as the case may be to provide power for additional illumination.

Figure 4:
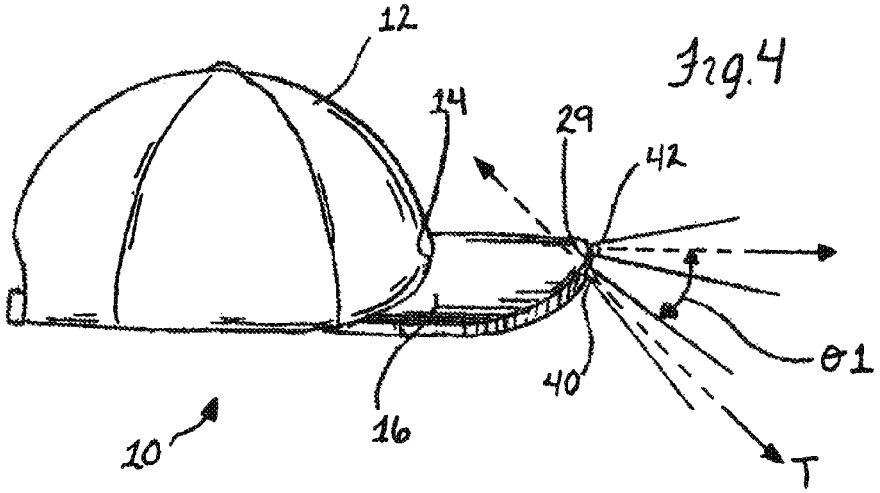
FIG. 4 is a side perspective view of a lighted hat having a first LED at the perimeter edge of a brim to provide illumination in a forward direction and a second LED at the perimeter edge of the brim to provide illumination in a downward direction.

In another example, the lighted hat 10 may include multiple high beam or low beam light sources mounted adjacent or at the perimeter edge 29 on the hat brim 16 as shown in FIG. 4. By one approach, the lighted hat 10 may include at least two light sources 40 and 42, preferably LEDs, that are spaced from each other on opposite sides of a centerline of the hat brim 16, such as provided in Applicant's U.S. Pat. No. 6,659,618, which is hereby incorporated herein in its entirety. By having two spaced LEDs on either side of the brim center line, the lighted hat 10 may provide enhanced illumination by doubling lighting of the viewing or working area of the wearer. By positioning the light source away from the hat's centerline and maintaining the spacing of the LEDs 40 and 42 from each other on the brim 16, the hats herein offer enhanced depth perception of an area to be illuminated because the illumination from the spaced LEDs 40 and 42 provide well defined shadows and texture to the object being illuminated. The LEDs 40 and 42 may each be high beams, low beams, or a combination thereof as described above and, thus, embody the various characteristics (i.e., cant angles, beam widths, and the like) for each type of LED, but each are positioned at or adjacent the perimeter edge 29.

In one example, the LED 40 may be a low beam light source (similar to LED 36) mounted at the perimeter edge 29 of the brim 16 and positioned in the brim 16 to provide a beam of illumination along an axis T that is approximately 15 degrees to approximately 40 degrees from the brim axis B described above. Because the LED 40 is disposed at the perimeter edge 29, the beam of illumination will illuminate an area slightly forwardly of the area relative to the low beam light source 36 described above so that the illuminated area does not include areas under the brim 16. In one example, the LED 40 may be positioned at a cant angle θ1 of approximately 15 degrees to approximately 40 degrees from the brim axis B while also being substantially recessed within the brim 16 to allow the hat 10 to maintain a natural and thin appearance. In this example, the LED 42 may be a high beam light source (similar to LED 34) also mounted at the perimeter edge 29 of the brim 16 and positioned in the brim 16 to provide a beam of illumination generally along the brim axis B. The LED 42 may provide a beam of illumination to further distances from the wearer, such as approximately 4 feet to approximately 6 feet. To maintain the natural and thin appearance of the hat, the LEDs 40 and 42 may be substantially recessed within the brim 16 such that outer ends thereof only project from the brim 16 a short distance or, alternatively, are flush with the brim perimeter edge 29.

Referring now to FIGS. 5-14, another exemplary lighted hat 110 is illustrated that embodies light sources configured to illuminate in multiple areas or directions. The hat 110 is illustrated as a baseball-type cap 112 having a crown 114 and a brim 116 projecting forwardly from a lower, forward edge portion of the crown 114 although other types of headgear are also contemplated. In this embodiment, the hat 110 is designed to provide illumination from the light sources, which are generally configured to focus illumination at a variety of different distances from the hat 110. By one approach, the hat 110 has the light sources mounted on the brim 116 to project cones of light along different axes.

In particular, the lighted hat 110 includes a first or high-beam light source 130 at or near a perimeter edge 129 of the brim 116. The high beam light 130 may be similar to the previously described high beam light 34. The hat 110 also includes a second or low-beam light source 132 that is remote from the brim perimeter edge 129 and preferably mounted intermediately along a lower major surface 131 of the brim underside. Light 132 may be similar to the previously described low beam or look down light 36.

Figure 5:
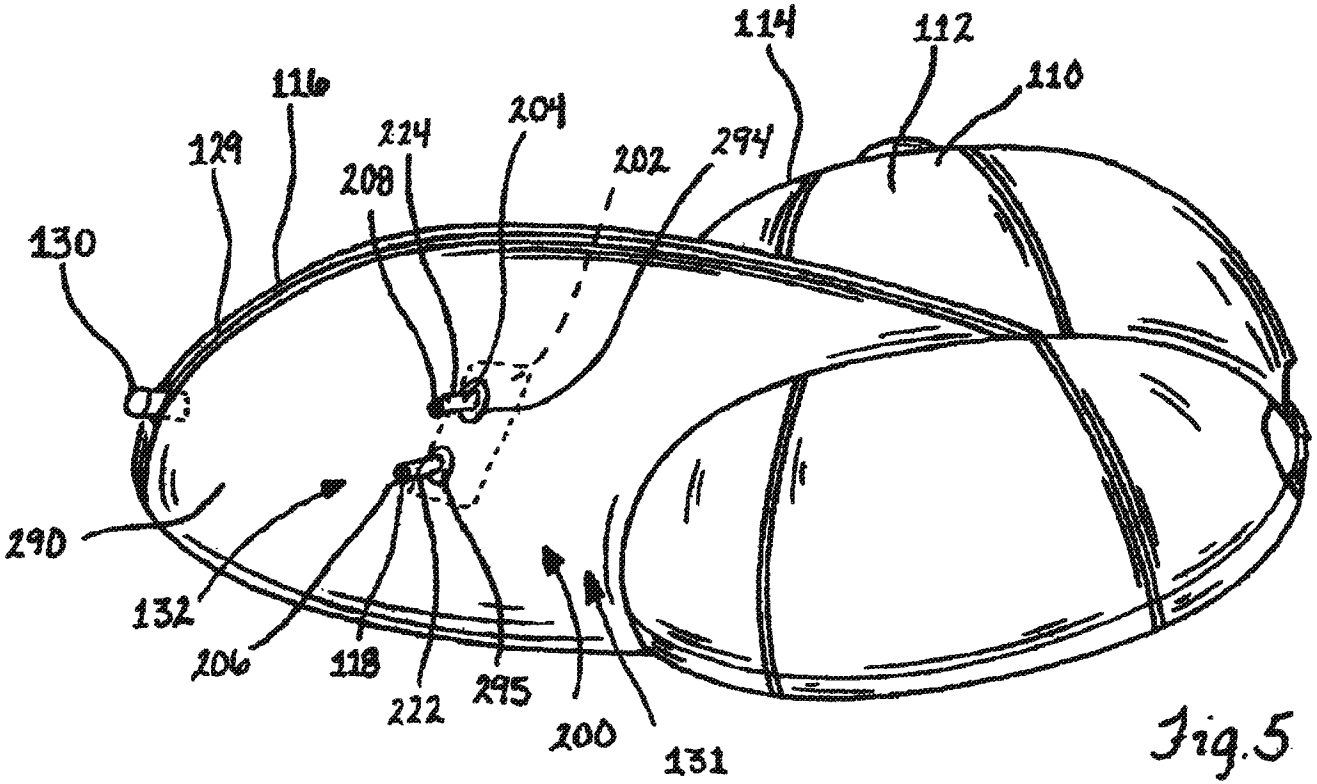
FIG. 5 is a bottom perspective view of a lighted hat showing a light holder for mounting LEDs to a bottom portion of the brim and an LED at the perimeter edge of the brim.
Figure 6:
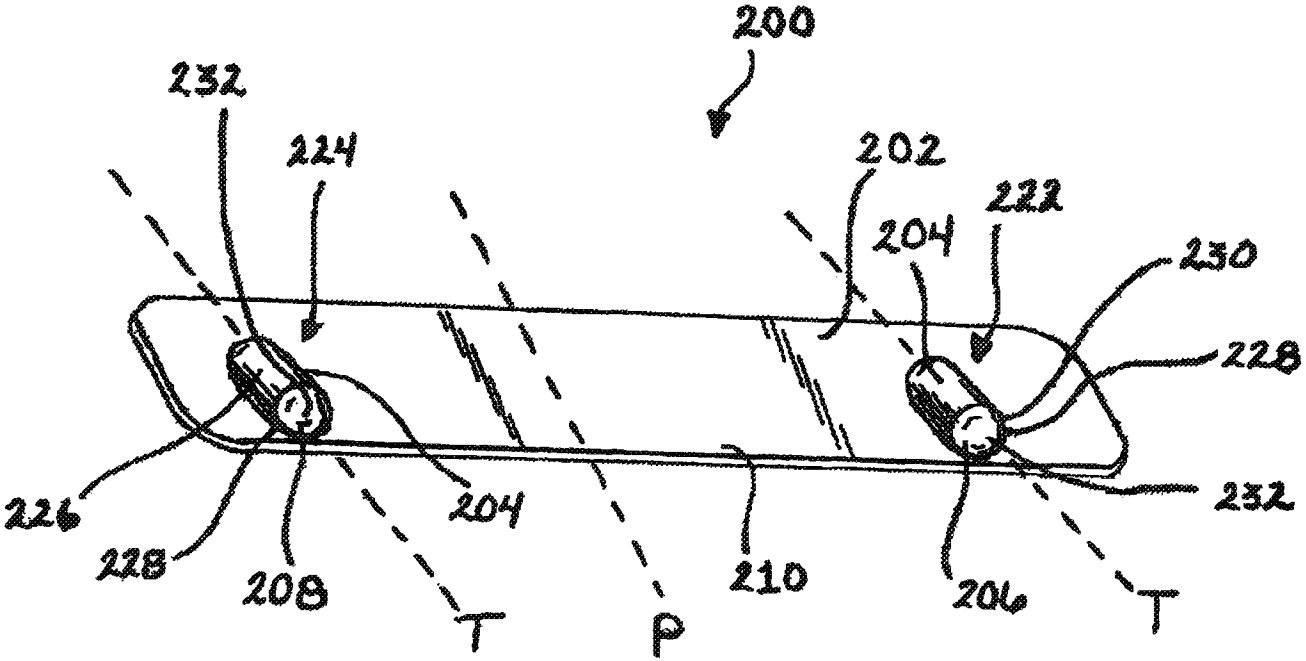
FIG. 6 is a perspective view of the light holder having a thin mounting base including two annular housing portions spaced from one another along the base and configured to receive LEDs in a fixed orientation therein to provide illumination in a transverse direction to the plane of the base.
Figure 7:
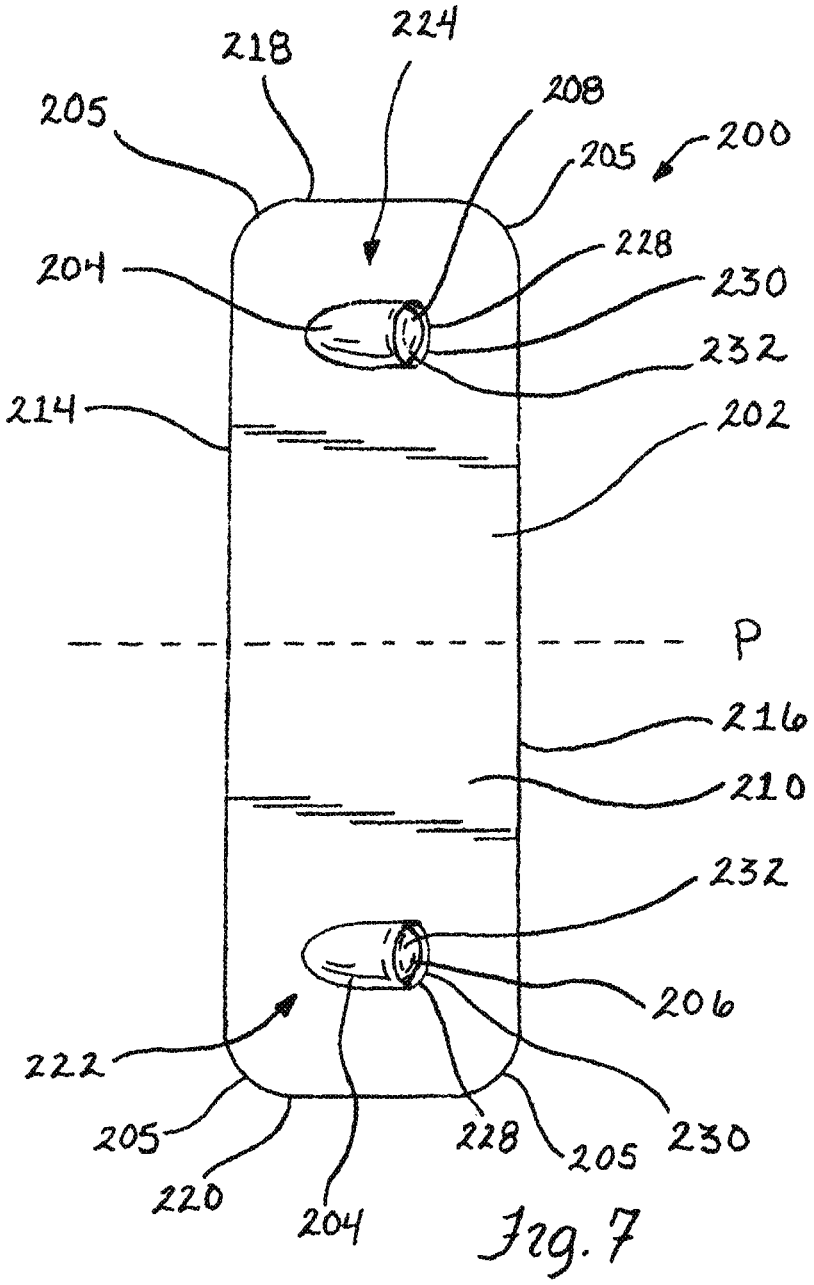
FIG. 7 is a bottom view of a light holder.
Figure 8:
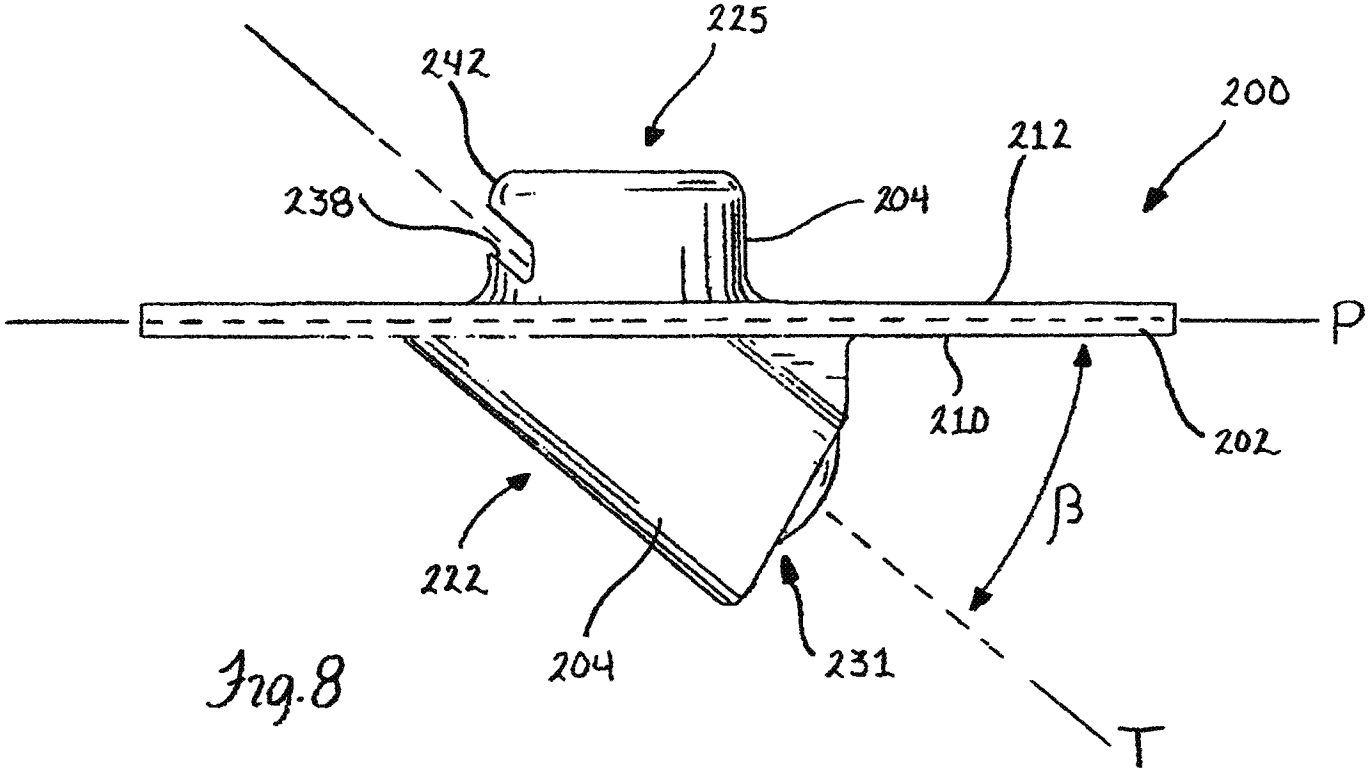
FIG. 8 is a side view of a light holder showing the thin mounting base and one of the annular housing portions extending below the mounting base to receive a LED therein, and a protrusion extending above the mounting base to receive at least an end portion of the LED.
Figure 9:
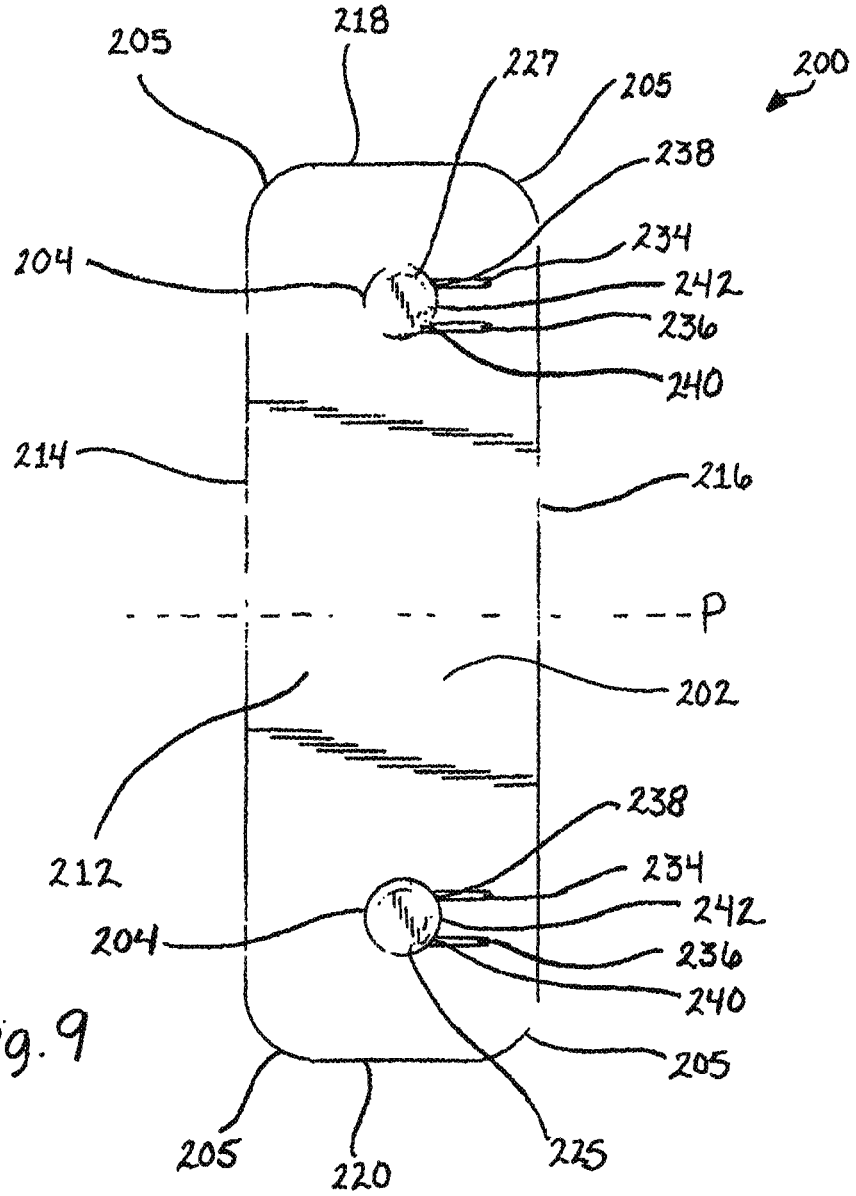
FIG. 9 is a top view of the light holder showing the two protrusions spaced from one another along the mounting base.

Referring to FIG. 5, the lighted hat 110 includes a light holder or hat lighting assembly, light mounting assembly, or hat lighting assembly 200 for securing the light source 132 to the lower major surface 131 of the brim 116. By one approach, the light holder 200 is used to secure two spaced light sources 206 and 208 in a fixed position relative to the brim 116 to illuminate an area below the brim 116. As shown in FIG. 5, the light holder 200 may be secured to the brim 116 of the lighted hat 110 and positioned to allow the light sources 206 and 208 to direct illumination in a direction downwardly and forwardly away from the lower major surface 131 of the brim 116 and to a close viewing distance of the wearer. The light source 130, on the other hand, may direct illumination in a direction generally along the brim axis B as described above.

Referring to FIGS. 6-9, one form of the light holder or hat lighting assembly 200 is shown in more detail. By one approach, the light holder 200 includes an elongate mounting base or member 202 and light holder or housing portions or light modules 204 sized to receive the light sources 206 and 208. Preferably, the mounting base 202 has a plate-like body that is thin and flat so as to have a minimal thickness thereby allowing the light holder 200 to be attached adjacent or to the brim 116 while maintaining the traditional thin and natural appearance of the brim 116. The elongate mounting base 202 includes an elongate lower surface 210 and opposite, upper surface 212 as best shown in the side view of FIG. 8. The lower surface 210 is generally flat and, by one approach, includes a lower section of the light holder portions 204 extending below the lower surface 210. The opposite, upper surface 212 is also generally flat and includes an upper section or rear projection of the light holder portions 204. The light holder 200 and, in particular the mounting base 202 thereof, may be made from a flexible and/or resilient material, such as a plastic or rubber material, so that the base 202 is sufficiently flexible to conform and bend to curvature typically found in the brims of baseball style hats. Other similar flexible and conforming materials may be used for the light holder 200 including a paperboard or rubber-like material or other resilient material. In addition, the light holder 200 can be of an aluminum or other heat dissipating material which can be particularly useful for higher power LEDs.

By one approach, the mounting base 202 has a generally thin, rectangular shape including rounded corners 205 connecting opposite front and back edges 214 and 216 (extending lengthwise generally parallel to one another) with opposite side edges 218 and 220 (extending parallel to one another and generally perpendicular to the longitudinal edges 214 and 216). A base lateral or fore-and-aft axis P extends along and from the plane of the mounting base 202 and generally parallel to the opposite side edges 218 and 220 and generally perpendicular to opposite the front and back edges 214 and 216.

The light holder portions 204 are connected to the mounting base 202 and configured to receive the light sources 206 and 208 therein. By one approach the light holder portions 204 may be seamlessly integrated with the mounting base 202 to provide a one piece light holder 200 and thereby permit secure attachment of the light sources 206 and 208 to the light holder 200 and hat 110. In one example, the light holder portion 204 includes spaced housing portions or bezels 222 and 224 on one side of the base 202 and corresponding spaced protrusions 225 and 227 on the other side of the base 202. The lower housings 222 and 224 may be spaced apart from one another and joined to the lower surface 210 of the mounting base in an integral construction to provide the one piece light holder 200. As discussed more below, the housings 222 and 224 have an opening or cavity therein sized to receive the light sources 206 and 208 at least partially therein. The housings 22 and 224 fix the light sources 206 and 208 in an orientation for providing beams of illumination in a direction away from the lower surface 210 of the mounting plate at an angle generally transverse to the brim axis B wherein the light holder 200 is mounted to the brim. To this end, the housings 222 and 224 can have a side wedge configuration so as to extend in a downward direction from the base surface 210 at an oblique angle of inclination relative to the base axis P of the mounting base 202. The housings 222 and 224 each have an axis T that extends transversely to and at a downward inclination β (FIG. 8) to the plate axis P of the mounting base 202. The housing axis T extends along a fore-aft axis generally defining a body of each housing 222 and 224. In one example, the housing axis T is angled approximately 15 degrees to approximately 40 degrees from the plate axis P, thereby fixing the light sources 206 and 208 respectively at the oblique angle of approximately 15 degrees to approximately 40 degrees from the plate axis P.

By one approach, each lower section of the light housings or housing portions 222 and 224 may have a generally cylindrical and hollow body 226 that extends from the lower surface 210 of the mounting base 202 to a distal end 228 thereof. Each hollow body 226 has a pocket or socket 231 capable of receiving and housing light sources 206 and 208, such as LEDs in the fixed configuration described above.

Referring to FIGS. 10-13, the housing bodies 226 are shown in more detail. By one approach, the housing body 226 includes an annular wall 250 extending about the axis T. The annular wall 250 may extend from the base surface 210 in a direction generally transverse thereto. The distal end 228 has a generally circular outer end surface 230 that forms an opening to the pocket or cavity 231 to receive the light source therein. Thus, the light source may be securely mounted in the cavity 231 and surrounded by the wall 250 to orient the light in a direction to provide illumination generally along the axis T of the housing. The light holder 200 therefore provides an easy and convenient way to mount two separate light sources 206 and 208 on the underside of a hat brim and cant both light sources at the same time and in the same predetermined downward angle of inclination.

Figure 10:
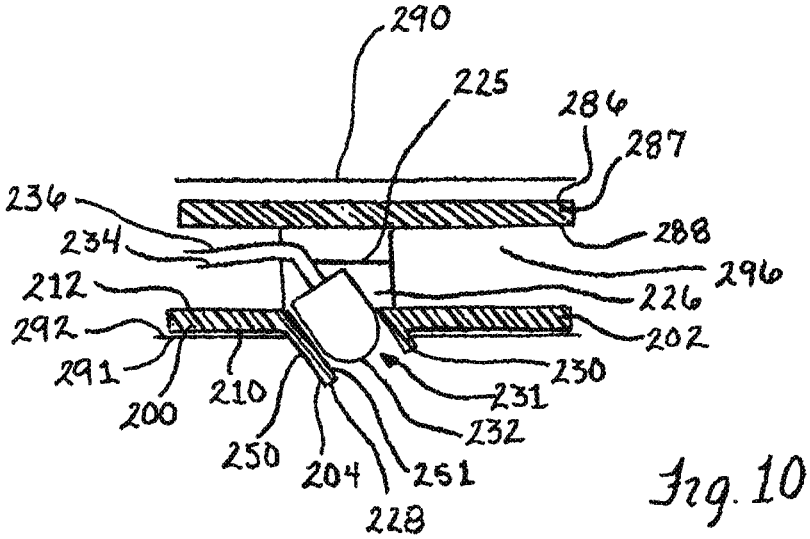
FIG. 10 is a side fragmentary cross-sectional view of the brim showing the light holder mounted to brim covering material with an LED received in the housing portion such that an outermost end of the LED does not extend past an outermost edge of the housing portion.
Figure 11:
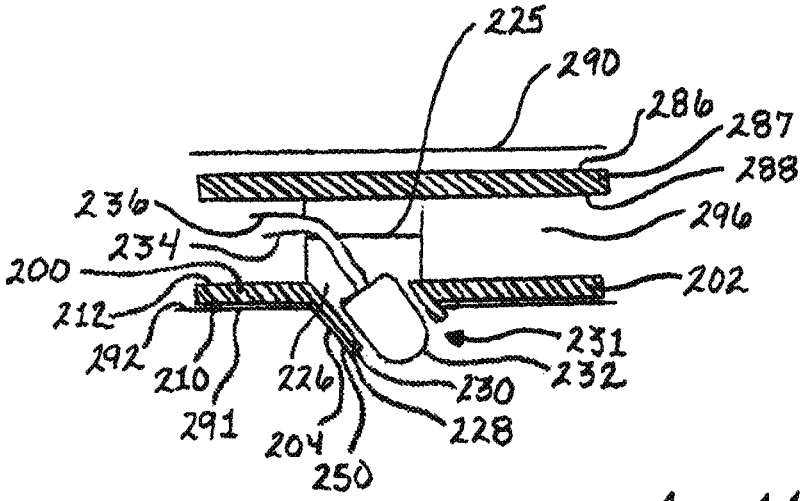
FIG. 11 is a side cross-sectional view of the brim showing an alternate light holder mounted to brim covering material with an LED received in a housing portion such that an outermost end of the LED extends past the outermost edge of the housing portion.

In one approach, the light sources 206 and 208 may be LEDs secured in the cavity 231 of the hollow body 226 of each housing 222 and 224. The LED may have a cylindrical lens body portion with an outermost cap portion 232 configured to emanate a beam of illumination from a chip located within the lens portion. In one example, the LED is positioned such that the wall 250 surrounds the LED body while the lens outermost cap 232 projects past the outer surface 230 of the annular housing body 226 as shown in FIG. 11. Preferably, the wall 250 still extends axially beyond the illumination chip. The configuration of FIG. 11 allows the LED to provide direct illumination to a location with a wider light cone because there is little or no interference therewith or reflection from an inside portion of the hollow body 226. In another embodiment, such as that of FIGS. 10, 12, and 13, the LED may be secured within the cavity 231 such that the lens outermost cap 232 of the light source is fully housed within the hollow body 226 and is flush or otherwise does not extend past the outer surface 230 of the housing 226. In this configuration the illumination chip is recessed further back in the cavity 231. This allows an inside portion 251 of the housing wall 250 to provide a more focused narrow light beam and/or to be a blinder device to block incident or stray light while also providing the benefit of having the wall 250 to protect the lens of the LED from damage if the lighted hat is dropped.

Referring back to FIG. 9, the light holder portions 204 also include the rear protrusions 225 and 227 that extend above the upper surface 212 of the mounting base 202. The protrusions 225 and 227 provide a socket or base to seat the light sources 206 and 208. For example, each protrusion 225, 227 may be substantially hollow so that the cavity 231 of the housings 222 and 224, respectively, also extends into the corresponding protrusions so as to allow the protrusions to at least partially receive the light sources 206 and 208 therein. In one example, the light sources 206 and 208 are LEDs and each has two leads 234 and 236 that extend generally upward through the annular housings 222 and 224 and into the protrusions 225 and 227. The protrusions 225 and 227 each have an outer surface 242 in which two spaced openings 238 and 240 are located. These openings are configured to extend through the outer surface 242 to the cavity 231. Each of the light sources 206 and 208 are positioned at the cavity 231 such that the two leads 234 and 236 of each of the light sources 206 and 208 extend through the openings 238 and 240 to securely mount the lights 206 and 208 in the housings 226 and position the leads for connection to various electrical components of the hat.

In this manner, the light holder 200 serves as a mounting frame for the LED light sources 206 and 208 so that after the light holder 200 is attached to the brim 116, assembly of the LEDs 206 and 208 to the brim, and of the wiring harness to the LEDs 206 and 208 can be done in a relatively straightforward and simple manner. To this end, after the light holder 200 is secured to the brim 116, the LEDs 206 and 208 are fit into the cavities 231 of the housing portions 222 and 224 and protrusions 225 and 227 so that their leads 234 and 236 extend out through the rear openings 238 and 240 for being connected to the wiring from a switch and power source, such as a battery pack carried in the crown portion along the lower sweatband thereof.

In one embodiment and referring to FIGS. 10-13, the light holder 200 may be attached to the brim 116 of the lighted hat and fixed to provide illumination in a direction forwardly and below the brim. Alternatively, the light holder 200 may be fixed to provide illumination in other directions below the brim including away from the wearer, a backward direction toward the wearer, a side direction, or a combination thereof. The brim 116 may include a shape retentive brim member or insert 287 having an upper major surface 286 and a lower major surface 288 with an upper brim covering material 290 extending over the upper brim major surface 286 and a lower brim covering material 291 extending over the lower brim major surface 288. In the example of FIGS. 10 and 11, the light holder 200 can be attached to the lower brim covering material 291 in a fixed orientation so as to provide illumination forwardly and downwardly from below the brim 116 while still remaining largely undetectable and unnoticeable by individuals viewing the hat 110 because it is mounted to be substantially covered by the brim covering material 291 between the lower surface 288 of the insert 287 and the covering material 291. Alternatively, the light holder 200 may be fixed to different locations at the brim to provide a variety of different configurations for providing illumination.

In the illustrated example of FIGS. 10 and 11, the light holder 200 is attached to an inside surface section 292 of the lower brim covering material 291 and is positioned in a space 296 between the lower major surface 288 of the brim and the lower covering material 291 created the offsets, standoffs, or protrusions 225 and 227 spacing the material 291 from the more rigid insert 287. To this end, the brim covering material 291 has spaced openings 294 and 295 (FIG. 5) to receive each of the spaced housings 226 extending therethough. The lower surface 210 of the mounting base 202 may be secured to the inside 292 of the lower brim covering material 291 by adhesive, staples, Velcro, sewing, stitching, ultrasonic welding, or other fastening mechanisms. So configured, the light holder 200 is positioned on the inside section 292 of the lower brim covering material 291 such that the annular housings 222 and 224 and the light sources 206 and 208 at least partially extend through the openings 294 and 295, respectively, to provide illumination in a generally forward and downward direction away from the brim lower major surface 288 to illuminate an area that is at a relatively close distance from the wearer as described above.

By mounting the light holder 200 to the inside surface 292 of the lower brim covering material 291 as discussed above, the natural thickness of the brim 116 is substantially maintained and thereby allows the brim 116 to maintain its natural and streamlined appearance of a typical baseball type cap. The housings 222 and 224 and light sources 206 and 208 may extend only a short distance through the openings 294 and 295 so as to adequately provide illumination while still remaining substantially concealed to third party viewers and not interfering or blocking the line of vision of the wearer. In this configuration, the lens outermost curved cap portion 232 of the LED light sources 206 and 208 are only minimally exposed at the exterior of the brim 116 to allow for a direct beam of illumination to illuminate an area below the brim 116. This configuration allows for direct illumination to be provided without the use of any reflectors or diffusers.

The protrusions 225 and 227 extending from the upper surface 212 of the light holder 200 contact portions of the lower major surface 288 of the insert 287 of the brim 116 to form the brim space 296 located between the lower brim covering material 291 and the lower major surface 288 of the brim insert 287. By using the light holder 200 to form and/or maintain the brim space 296, the hat 110 advantageously includes a space sized to allow wires, electrical connections, circuit boards, and other conductive paths and electronic components to be housed within the space 296. For example, the interior brim space 296 can be used to connect a power source to the switch or switches and/or light sources and at the same time be concealed from view. In one example, leads 234 and 236 of the light sources may extend out of the protrusion 225 and be connected by a conductive path to a switch that is disposed to the brim 116 or a battery or power source disposed in the brim or elsewhere on the light hat 110, such as within a sweatband of the hat 110. The height of the annular protrusions 225 and 227 are short enough (e.g., approximately 1 mm) to provide a relatively small brim space 296 with just enough room to house all the necessary electrical connections to provide proper functioning of the light sources while still maintaining the streamlined appearance of the hat 110 and, at the same time, not substantially altering the natural thickness of the brim 116. In this regard, since hat brims are typically curved upwardly toward their lateral center if the light holder 200 is centered under the hat brim, the space added to be brim thickness by space 296 will be insignificant as the brim still will have portions thereof that extend below the bottom of the brim space 296 particularly along the brim outer side portions, and thus will not be very noticeable at all to third parties.

Figure 12:
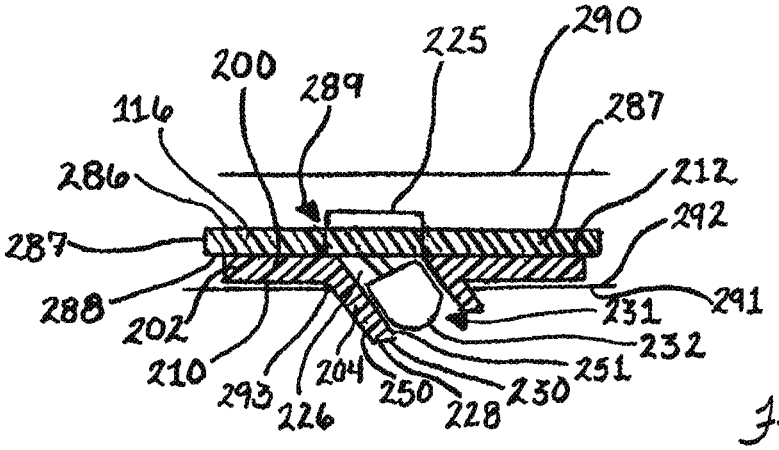
FIG. 12 is a side cross-sectional view of the brim showing the light holder mounted to a lower major surface of the brim insert with an LED received in the housing portion to provide illumination in a direction below the brim.

In another example and referring to FIG. 12, the light holder 200 may also be attached directly to the lower major surface 288 of the brim insert member 287 rather than the inside surface 292 of the lower brim covering material 291. With this approach, the shape-retentive brim member 287 may have an opening 289 creating a passageway or slot to receive the projections 225 and 227 so that the base 202 and an upper surface 212 thereof may sit flush against the lower surface 288 of the brim 116. In this instance, the standoff projections 225 and 227 would engage the upper brim covering material 290 to create a space between the material 290 and the insert 287 for receipt of electrical components, such as wiring, therein. In this example, the light holder 200 may be attached to the lower major surface 288 of the brim 116 by adhesive, sewing, stitching, staples, ultrasonic welding, heat welding, or other fastening mechanisms.

Figure 13:
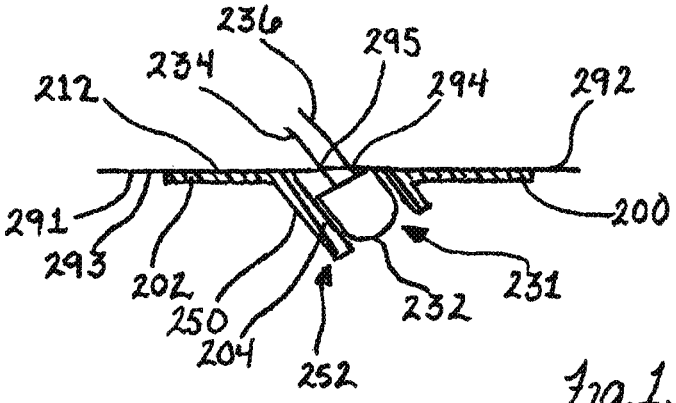
FIG. 13 is a side cross-sectional view of the brim showing the light holder mounted to an outside section of the brim covering material with an LED received in the housing portion to provide illumination in a downward direction.

In another example and referring to FIG. 13, the light holder 200 may be attached to an outside surface 293 of the lower brim covering material 291 rather than the inner surface 292. By using this approach, the upper surface 212 of the mounting plate may be attached to the brim covering material 291 by an adhesive, staples, Velcro, sewing, stitching, ultrasonic welding, or other fastening mechanisms. The brim covering material 291 may have the openings 294 and 295 that provide a passageway from a location underneath the brim 116 to a location above the brim covering material 290 for receipt of the protrusions 225 and 227. The protrusions or standoffs 225 and 227 function much the same way as previously described to create space between the brim insert 297 and the lower covering material 291 for the wiring harness and, if desired, other electrical components, such as a switch. When the light source 206 or 208 is an LED, the leads 234 and 236 thereof may extend through the openings 294 and 295 respectively to contact the electrical connections and other conductors that are located above the lower brim covering material 291.

Figure 14:
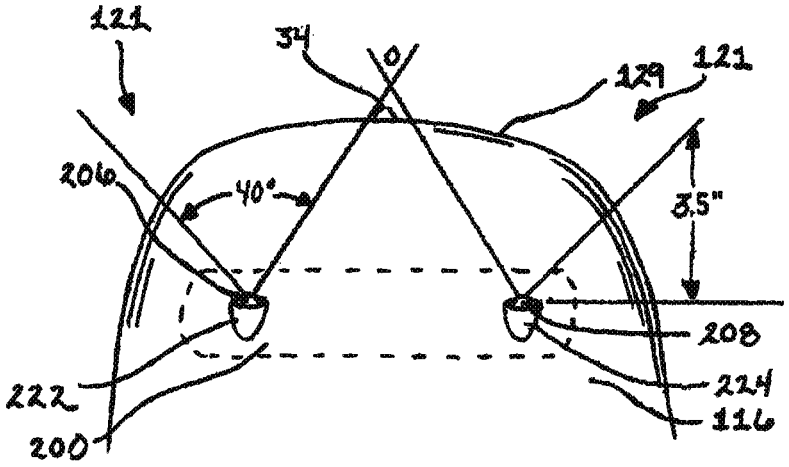
FIG. 14 is a bottom plan view of the brim having LEDs received in the light holder that is attached to brim covering material to provide illumination in a downward direction and having an LED mounted to the perimeter edge of the brim to provide illumination in a forward direction.

To provide illumination to a reading distance, the light holder 200 may be attached to the brim 116 and, in particular, the lower brim covering material 291 at a variety of locations relative to the brim perimeter edge 129. In one embodiment and referring to FIG. 14, the light holder 200 is remotely spaced from the perimeter edge 129 of the brim 116. In this example, the light holder 200 may be positioned on the brim 116 at an approximately a central position relative to a length and width of the brim 116. In another example, the length of the brim may be approximately 80 millimeters between the rear edge 27 and the front edge 129 along the brim's fore-and-aft axis B and the light holder 200 is positioned such that the light sources are spaced approximately 25 millimeters to approximately 28 millimeters from the front perimeter edge 129. The housings 222 and 224 holding the light sources 206 and 208 may be spaced a distance of approximately 35 millimeters to approximately 65 millimeters from one another and canted downward at an angle of approximately 15 degrees to approximately 40 degrees from the plate axis P of the mounting base 202. In this example, the light sources 206 and 208 are preferably LEDs each having a light cone 121 of approximately 20 degrees to approximately 40 degrees. In one example and still referring to FIG. 14, the light sources are spaced a distance of 65 millimeters and have light cones of 40 degrees. This configuration will provide optimal illumination at a distance of about 3 inches to about 30 inches from the light sources which is a distance just past the perimeter edge 129 of the brim 116 to a normal reading distance of a wearer. As shown in FIG. 14, the 40 degree light cones will generally overlap at a point O that is about 3 inches to about 8 inches from the light sources. At a distance less than about 3 inches from the light sources, dark shadows or dark, unlit areas are present between the light cones 121 that cause portions of objects viewed within that distance to be generally un-illuminated. It will be appreciated that the above dimensions and distances are only exemplary and can be varied as needed for particular applications. In addition, the light holder 200 could be configured to carry only one light source or more than two light sources.

Referring again to FIGS. 5 and 14, the high beam light source 34, 130 as described above may be attached adjacent to or at the perimeter edge 129 and be used in combination with the light sources 206 and 208 received in the light holder 200. The high beam light source 34, 130 may be positioned to extend from the perimeter edge 129 of the hat brim 116 to direct light forwardly of the wearer. By one approach, the high beam light source 34 may also be canted relative to the brim axis B at a cant angle θ2, but is canted over a smaller angle θ2 than the light sources 206 and 208 carried by the light holder 200. For example, the high beam light 34, 130 may be canted 0 degrees to about 15 degrees downwardly from the axis B, and preferably about 5 degrees to about 15 degrees. By one approach, the LED 34, 130 is positioned at the centerline of the brim 116. More specifically, the high beam light 34 may be a 20,000 MCD light emitting diode having about a 15 degree to about a 20 degree light cone that is canted downwardly from the brim fore-and-aft central axis B by about 5 degrees. Together, the high beam light source 34, 130 and the light sources 206 and 208 received in the light holder 200 may project illumination to different distances in a similar manner as described above.

Figure 15:
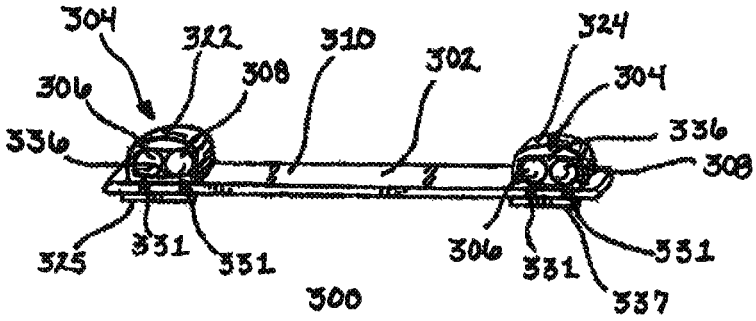
FIG. 15 is a perspective view of an alternative light holder having two housing portions each sized to receive two LEDs therein.
Figure 16:
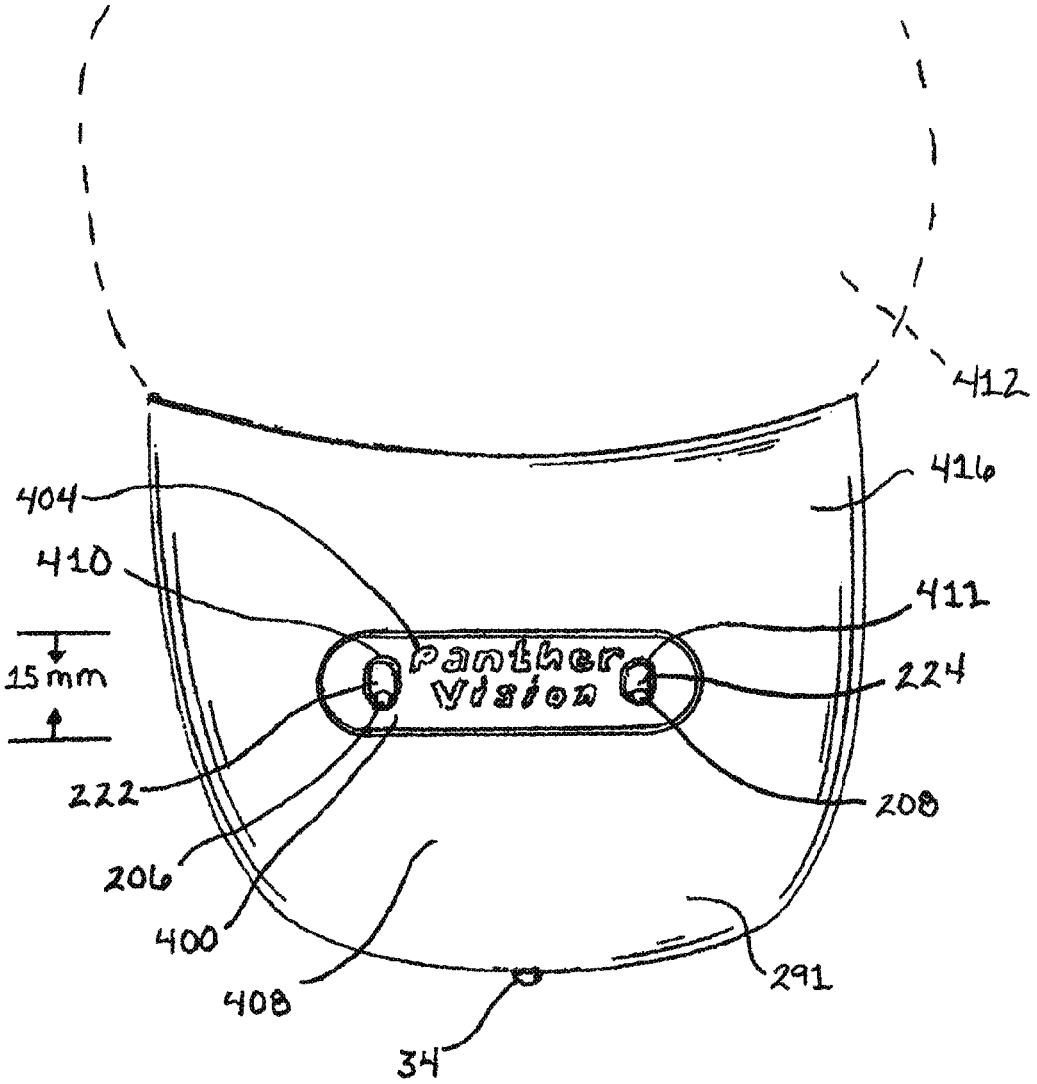
FIG. 16 is a bottom plan view of a mounting patch at the bottom of the brim with the annular housing portions of the light holder partially protruding through openings in the mounting patch.

In another embodiment and referring now to FIG. 15, an alternative light holder 300 is shown that includes a mounting base 302 similar to the mounting base 202 described above with two holder portions 304. The holder portions 304 may include stand offs or protrusions 325 and 327 and housings or modules 322 and 324 spaced from one another and extending from a lower surface 310 of the mounting plate similar to the previous holder 200. The housings 322 and 324 may each have a body 336 sized to each hold and receive two separate light sources 306 and 308 where the light sources are preferably LEDs. By one approach, each housings 322 and 324 includes two cavities 331 that are each sized to receive one LED. Also, similar to the previous light holder 200, each of the protrusions 325, 327 has four openings (not shown in this embodiment) extending through the housing to the cavity 331, to receive the leads of the LEDs. The four openings will be configured to receive a pair of leads from each of the two LEDs that are housed in each housing 322, 324. The leads pass through the openings to the area that is exterior to the light holder 300 where they can then be electrically connected to a switch, circuit board, power source or other component by an electrical connection therebetween, such as via wiring. This configuration allows the housings 322, 324 to each receive and hold two or more LEDs in an orientation to provide beams of illumination in a downward direction below the brim 116. Each housing portion 322 and 324 can fixedly hold one LED oriented to be the high beam light source such as at a small cant angle relative to the brim axis B, e.g. 10 degrees, with the other LED being fixedly held so that it is oriented to be the low beam or look down light source, e.g. at a 25 degrees cant angle to the brim axis B. In this manner, a stereo effect for providing enhanced depth perception with by the low beam and high beam LEDs is created due to their spacing from each other across the base 302 in the spaced housing portions 322 and 324. Alternatively, each housing portion can be configured so that they hold the LEDs in only one orientation either high beam or low beam, or both housing portions can be configured so that they all hold their respective LEDs therein at the same orientation such as in the low beam orientation.

In another example and referring to FIGS. 16-20, a lighted hat 412 is shown having a brim 416 with a covering portion or mounting patch 400 extending along a section of the brim 416 to provide a discrete surface to which the light holder 200 can be mounted. The mounting patch 400, therefore, may be provided on the lower brim covering material 291. The mounting patch 400 may be slightly larger than the footprint of the light holder 200 described above to provide a surface on which the entire mounting base 202 can be received. In one example, the mounting patch 400 may be an elongate area having a racetrack configuration of embroidered stitching, one or more additional fabric layers, or one or more fabric layers having an elongate embroidered portion thereon. Preferably, the mounting patch 400 is embroidered stitching extending through the covering material 291 to form the covering patch portion 400 on both sides of the lower brim covering material 291. In another example, the patch 400 may be silk screen paint, an ironed on patch, a double layered fabric or paper material, or any other material creating a larger, rougher, or stiffer portion of the brim 416. The patch 400 may be stitched to the fabric material 291 to form a thicker portion of the brim 416, but still be in a thin or flat configuration thereby allowing the lighted hat 412 and specifically the brim 416 of the hat 412 to maintain its natural streamlined appearance. For example, the thickness of the lower layer 291 of fabric material can be approximately less than 0.5 mm and the thickness of the embroidered patch portion 400 can be approximately 1 mm.

Figure 17:
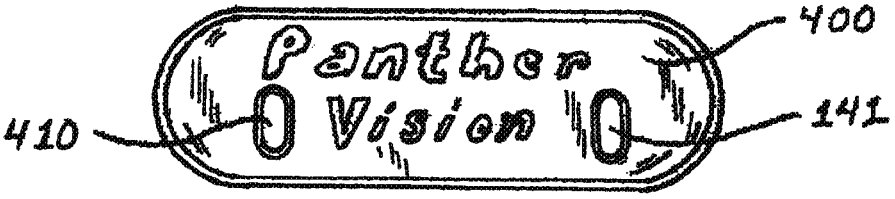
FIG. 17 is a bottom plan view of an embroidered mounting patch portion of the brim showing indicia sewn in its lower surface.

Preferably and as shown in FIG. 17, the mounting patch 400 is formed of embroidered stitching that forms an outer surface 404 with a stiffened, textured, or roughened surface characteristics formed via a plurality of adjacent and tightly packed stitches, needlework, other stitching to form the patch 400 thereof of yarn or thread. The outer surface 404 can include alphanumeric or graphical content, such as a logo or insignia to mark the name of a company or producer of the product. The stitching of the embroidery preferably extends through the fabric 291; thus, the mounting patch 400 also has an embroidered inner surface 406 that can include similar tightly packed stitches, needlework, or other stitching to form an inner stiffened, textured, or roughened surface consistent with the characteristics of embroidery or other needlework or stitching techniques. The inner surface 406 sits below and spaced from a lower major surface 408 of the brim 416 and provides an enhanced mounting surface for receipt of the light holder 200 described above. The textured inner surface 406 may provide more stability for attaching the mounting base 202 of the light holder 200 thereby creating a more secured attachment to the covering material 291 of the brim (which is preferably fabric) to prevent against any unwanted shifting or sliding of the light holder 200 during operation. By way of example, the embroidered stitching can have a stitch density of approximately 1800 stitches per square inch with threads that are approximately 0.005 inch thick.

Figure 18:
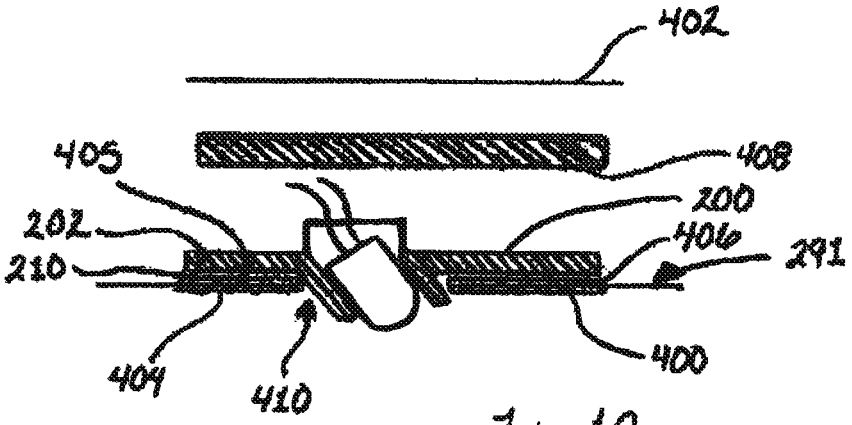
FIG. 18 is a side cross-sectional view of the brim having an embroidered portion of non-wicking material with the light holder adhered thereto.

The light holder 200 may be attached to the inner or inward oriented surface 406 of the mounting patch 400 by adhesive, sewing, stitching, ultrasonic welding, heat welding, or other fastening mechanisms. In one example, the light holder 200 is attached by adhesive 405, such as a hot melt glue or cyanoacrylate, placed between the lower surface 210 of the mounting base 202 and the inner surface 406 of the mounting patch 400 to provide a secure attachment between the light holder 200 and the preferable fabric material covering the brim, as best shown in FIG. 18. Commonly, material used for the brim covering material 291 in baseball style hats is a fabric that tends to have wicking properties that transfer liquids or fluid through the material by the process of capillary action. Thus, if liquid adhesive is used to mount the light holder 200 directly to the fabric, the adhesive (which may be heated to a generally liquid state for fastening the light holder 200 to the brim covering material 291) will also wick through the brim covering material 291 and transfer by capillary action through the material 291 to an outer section of the brim covering material 291 that generally corresponds to the area that the light holder 200 is attached to. This may result in an undesirable stain or blemish on an outside section of the brim covering material 291.

The mounting patch 400, on the other hand, provides a surface to mount the light holder 200 that is configured so that the adhesive will generally not wick therethrough or is thick enough so that the adhesive cures or solidifies before is reaches the outer surface 404 thereof. In one example, the mounting patch 400 may be a non-wicking thread, yarn, paper, or other fabric material, such as the tightly stitched embroidered patch, which is effective to keep the outer surface 404 generally free of the adhesive such that there are no stains or blemishes on the outer surface 404 or another outside section of the brim covering material 291. The patch 400 may also be thicker than the brim covering material 291 or have multiple layers so as to block the liquid adhesive from passing through the material 291 to the outer surface 404. If the surface 400 is thicker than the brim material 291, as mentioned above, the adhesive may harden and cure before it has time to reach the outer surface 404. Moreover, in the example where the light holder 200 is sewn or stitched to the brim, use of the mounting patch 400 may adequately conceal the sewing marks or stitching on the outer surface 404 due to its increased thickness thereby presenting a more aesthetic appearance.

The mounting patch 400 also has openings 410 and 411 sized and arranged to allow the housings 222 and 224 of the light holder 200 to pass therethrough to a location below the brim 416. The light holder 200 may be attached to the patch 400 where the lower surface 210 of the mounting base 202 engages with the inner surface 406 of the patch 400 and is attached thereto by the thin layer adhesive 405 described above (FIG. 18) so as to allow the brim 416 to maintain a thin and natural appearance. The openings 410 and 411 may be aligned with brim covering openings 294 and 295 thereby providing a complete passageway from an area located in the brim 416 (from the brim space 296) to an area located exterior and below the brim 416. This configuration allows the annular housings 222 and 224 to pass at least partially through both the openings 294 and 295 and the openings 410 and 411 so as to allow illumination to be provided from the light sources 206 and 208 secured in the annular housing 222 and 224.

Figure 20:
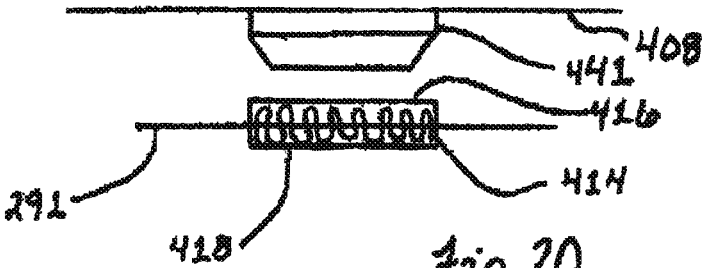
FIG. 20 is a fragmentary, side cross-sectional view of the embroidered portion covering the activation switch of FIG. 19.
Figure 19:
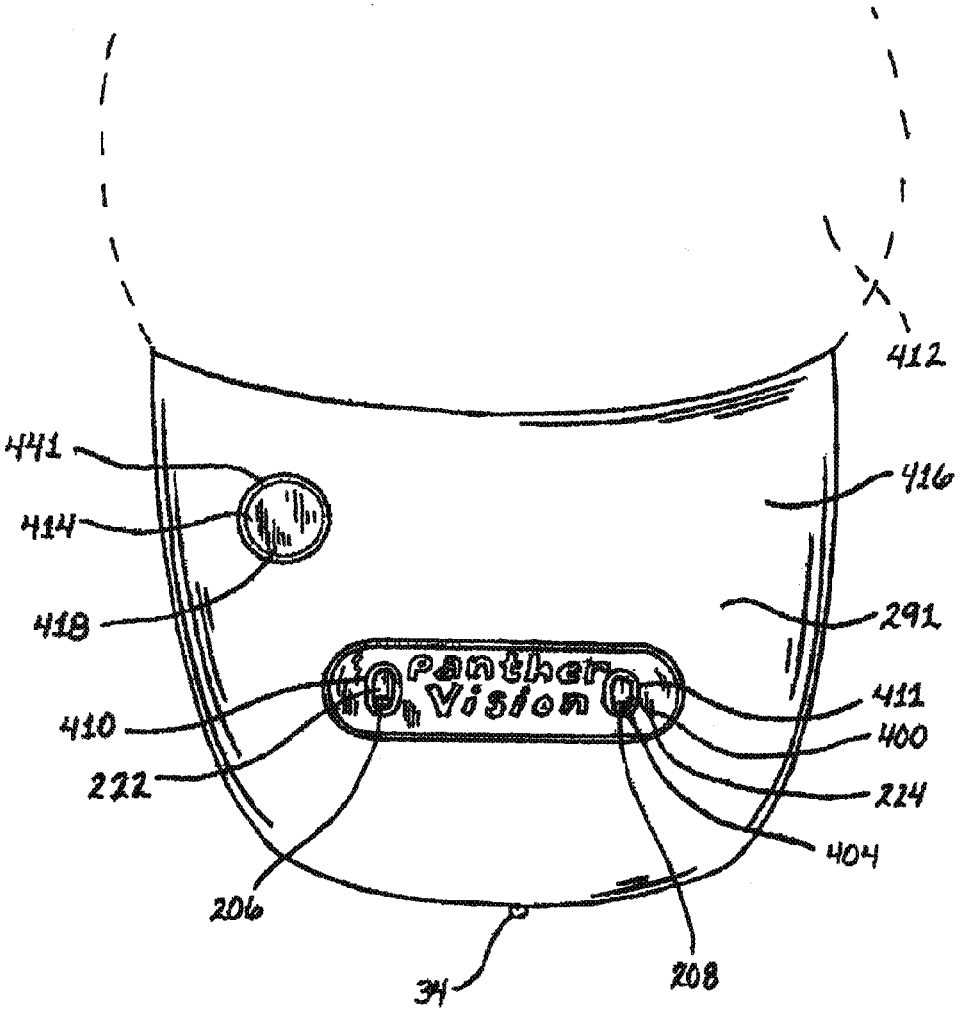
FIG. 19 is a bottom plan view of the brim including the embroidered mounting patch portion and another embroidered portion on the bottom of the brim identifying the location of an activation switch therein.

Referring to FIGS. 19 and 20, the brim 416 may also include an activation switch 441 mounted thereto. The brim covering material 291 may also include a switch covering portion 414 that may include features and characteristics similar to the mounting patch 400 discussed above. By one approach, the switch covering 414 may be generally circular and sized to overlap the activation switch 441 contained within the brim and covered by the brim fabric 291. The switch covering 414 may be formed by embroidered stitching that extends through the brim material 291 to form an inner surface 417 and an outer surface 418 (on opposite sides of the lower brim cover material 291) that both have textured or roughened surfaces similar to those discussed above with the patch 400. In this example, the activation switch 441 may be a pushbutton switch having an actuator in the form of a plunger capable of being depressed to activate at least one light source to an illuminated state. The plunger may be depressed again to deactivate a light source that is currently in the illuminated state or to change the state of any other light source that is in electrical communication with the components of the lighted hat 412. The activation switch 441 may be located between the brim covering material 291 and a lower major surface 408 of the brim insert. Without the switch covering 414, a user may have difficulty finding the location of the activation switch 441 and the plunger thereof when the switch 441 is covered by the brim covering material 291. This can cause a user to push on a portion of the brim covering material 291 that is not in general alignment with the plunger of the activation switch 441. In addition, a user may push the brim covering material 402 so as to contact the plunger of the activation switch 441, however, the brim covering material 402 will slide across the plunger without actually causing the plunger to be depressed since the area of the brim being pushed is not generally aligned with the switch plunger. With the greater rigidity provided by the thicker, embroidered switch cover 414, perfect alignment with the switch plunger is less important as long as the user pushes on the switch cover 414 to shift it toward the brim insert since the more rigid switch cover 414 will still depress the switch plunger.

The outer surface 418 of the switch cover 414 may have a similar textured surface as described when discussing the outer surface 404 of the mounting patch 400. The texture of the outer surface 418 provides the user with an indication of the location of the plunger of the activation switch 441 by finger touch. In one example, a user only needs to run a finger along the relatively smooth brim covering material 291 until it runs across the textured outer surface 418 thereby indicating to the user where the activation switch 441 is located. Moreover, the texture of the outer surface 418 provides more traction for a user's finger making it more difficult for the finger to slip off or shift from the outer surface 418 while attempting to depress the activation switch 441. Likewise, the inner surface 416 has a similar texture as described when discussing the inner surface 406 of the mounting patch 400. In one example, the plunger of the activation switch 441 is mounted in the brim 416, such as to the insert, to be spaced from the inner surface 417 in the brim 416. As a user presses on the outer surface 418, the brim covering material 291 moves to contact the plunger of the activation switch 441. The texture of the inner surface 417 provides a roughened surface to contact the plunger thereby allowing the plunger to be more easily depressed while keeping the plunger from sliding or shifting away from the brim covering material 291.

Figure 21:
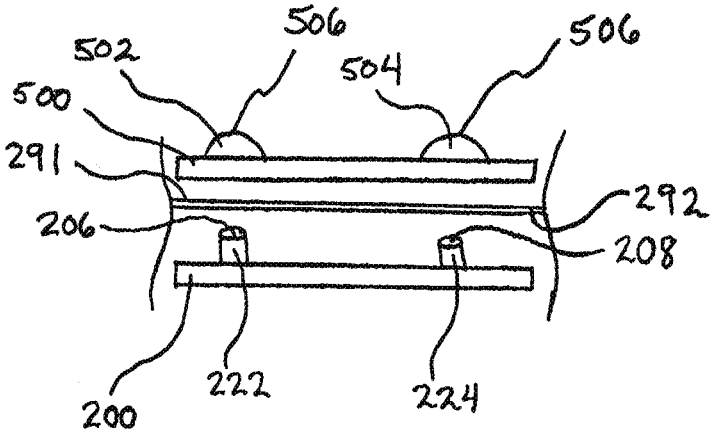
FIG. 21 is an elevational view of a light holder cover having a base plate including two projections spaced from one another for receiving the two housing portions of a light holder and for being fastened through brim covering material to the light holder.
Figure 22:
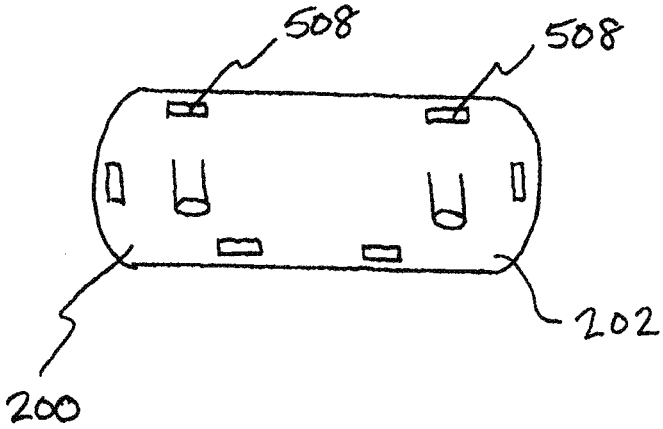
FIG. 22 is a plan view of the light holder capable of being received by the light holder cover of FIG. 21 having slots configured to accept staples to secure the light holder to the light holder cover through the brim covering material.

Turning to an additional example and referring to FIGS. 21 and 22, a light holder cover 500 may be used to help secure and/or conceal the light holder 200 to the brim fabric 291. The light holder cover 500 may be made of a flexible plastic or rubber material and include projections or hoods 502 and 504 positioned to receive the housings 222 and 224, respectively, of the light holder 200. Each projection 502 and 504 includes an opening 506 to allow illumination from the light sources 206 and 208 to illuminate a distance below the brim 116 and near the wearer. The light holder cover 500 could also be of aluminum or other heat dissipating material.

The light holder cover 500 will preferably be fastened to an outside section of the brim covering material 291, but may be fastened to the light holder 200 or the housings 222 and 224 thereof. For example, the light holder 200 may have slots 508 located on the mounting base 202 and configured to receive staples. In this example, staples may be inserted through portions of the light holder cover 500, the brim covering material 291, and be received securely through the slots 508 of the light holder 200 in a sandwich assembly. Such construction securely fastens the light holder 200 to the cover 500 with the brim covering material 291 in a sandwiched configuration between the light holder 200 disposed at the inside surface 292 of the brim covering material 291 and the light holder cover 500 disposed at the outside surface of the brim covering material 291.

In another example, the light holder 200 may be connected to the light holder cover 500 by sewing or stitching the light holder 200 to the light holder cover 500 with the brim covering material 291 sandwiched therebetween. In still another example, the light holder 200 may be attached to an outside section of the brim covering material 291, and the light holder cover 500 may then be attached directly to the light holder 200 or cover 291 via an adhesive, glue, sewing, stitching, ultrasonic welding, staples or other fastening mechanisms. The rubber or flexible material of the cover 500 helps provide a strong and flexible housing for the light holder 200 and helps protect the light sources contained therein from damage caused by any contact while still allowing the light sources to provide illumination at a location forwardly and below the brim 116.

Figure 23:
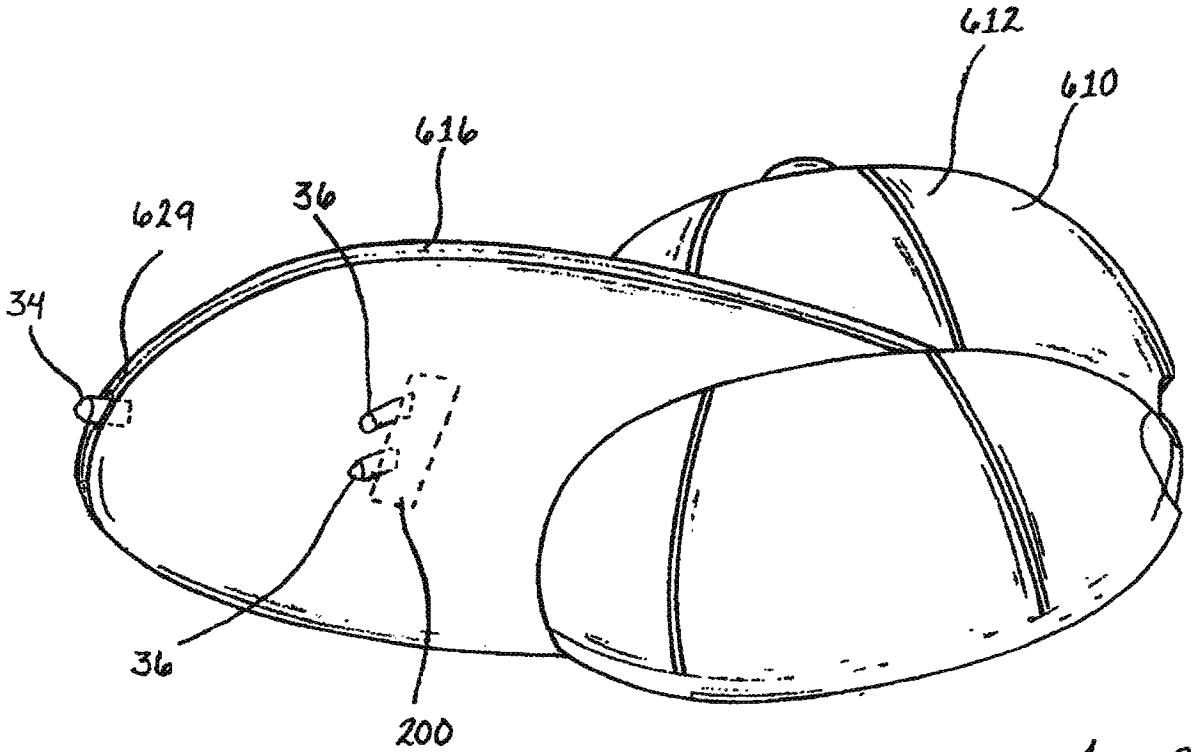
FIG. 23 is a bottom perspective view of a lighted baseball hat having a brim and a light holder integrally attached thereto as a one-piece body and configured to provide illumination in a direction below the brim.

Referring now to FIG. 23, another embodiment of a lighted headgear 610 is shown having a crown 612 and a brim portion 616 having light sources configured to provide illumination in a generally forward direction. The brim portion 616 may contain a high beam light source 34 disposed at a perimeter edge 629 thereof configured to provide illumination in a generally forward direction. The high beam light source 34, is preferably an LED configured to be at least partially recessed in the brim portion 616, as described above, so as to be substantially concealed and thereby maintain the natural and streamlined appearance of the lighted headgear 610. A low beam light source 36 may be disposed at a location underneath the brim 616 to provide illumination in a direction forwardly and below the brim 616 as described above. The low beam light source 36 may be LEDs received in the light holder 200 as generally described above. In this embodiment, the brim portion 616 and the light holder 200 thereon may be constructed of a substantially one piece body where the holder 200 is integrally attached or molded to the brim portion 616. A common method of manufacturing that could be used to provide this configuration may be an injection molding manufacturing process. This configuration generally provides an integral and strong light holder 200 fused below the brim portion 616 to provide illumination in a direction below the brim portion 616. In another example, the entire lighted hat 610 may be a one piece body that includes the light holder 200 and the high beam light source 34. This may provide added stability to the entire hat thereby making it more durable for a variety of different activities.

Referring to FIGS. 24-30, another exemplary form of lighted headgear 700 is illustrated including one or more light sources 702 configured to illuminate in multiple directions. The headgear 700, in the form of a baseball-type hat, is illustrated having a crown 704 and a brim 706 projecting forwardly from a lower, forward edge portion 708 of the crown 704. In this embodiment, the hat 700 is designed to provide illumination from the light sources 702 mounted to the brim 706, which are generally configured to direct illumination to at least two different directions and/or distances from the hat 700. The light sources 702 can have light cones with a range of about 15 degrees to about 40 degrees, as discussed above.

Similar to the light sources discussed with the previous embodiments, the plurality of light sources 702, which are preferably LEDs, can be configured and disposed on the lighted hat 700 to provide illumination in multiple directions. In the illustrated form, the brim 706 of the lighted hat 700 generally extends in a fore-and-aft direction along a brim axis B. The lighted hat 700 has at least one light source 703 positioned to direct light generally along the brim fore-and-aft axis B and at least one light source 705 mounted on the brim 706 to direct light at an angle relative to the brim axis B, such as along the axis T that extends downward from and transversely or obliquely to the brim axis B. In these embodiments, the light sources 702 are configured to illuminate objects in areas that are different distances away from the hat 700. For example, the light source 703 configured to emit light along the brim axis B will provide illumination upon an object or a location at a distance relatively far away from the wearer, such as approximately four feet to approximately six feet from the wearer, and the light source 705 configured to emit light at an angle to the brim axis B along the axis T will provide illumination upon an object or a location at a distance closer to the wearer, such as at a reading or working distance of approximately 3 inches to approximately 30 inches, without requiring the wearer to shift his head in any given direction. This configuration allows multiple distances to be illuminated simultaneously or at alternating times to thereby allow a wearer to see both objects at a distance and objects at a closer distance without substantial tilting or movements of the head or of the lighted hat 700 worn thereon.

In this form, the hat 700 includes an externally mounted light holder or hat lighting assembly 710 to house and/or receive at least one lower light source 705, and preferably two lower light sources 705, in a fixed orientation to direct light along the axis T to an area forwardly and below the brim 706. The external light holder 710 mounts to or adjacent an outer lower major surface 714 of the brim 706, so that the light sources 705 direct light generally away from the lower major surface 714 of the brim 706. The light holder 710 and components thereof may be made from a resilient and/or flexible material such as a rubber or plastic material so that the light holder 710 can conform and bend with the brim 706. The material used to make the light holder 710 may further be opaque such that light emitted from the light sources 705 substantially cannot pass therethrough to prevent stray light from getting into the eyes of a wearer of causing a glare in eyeglasses worn by a wearer.

Figure 24:
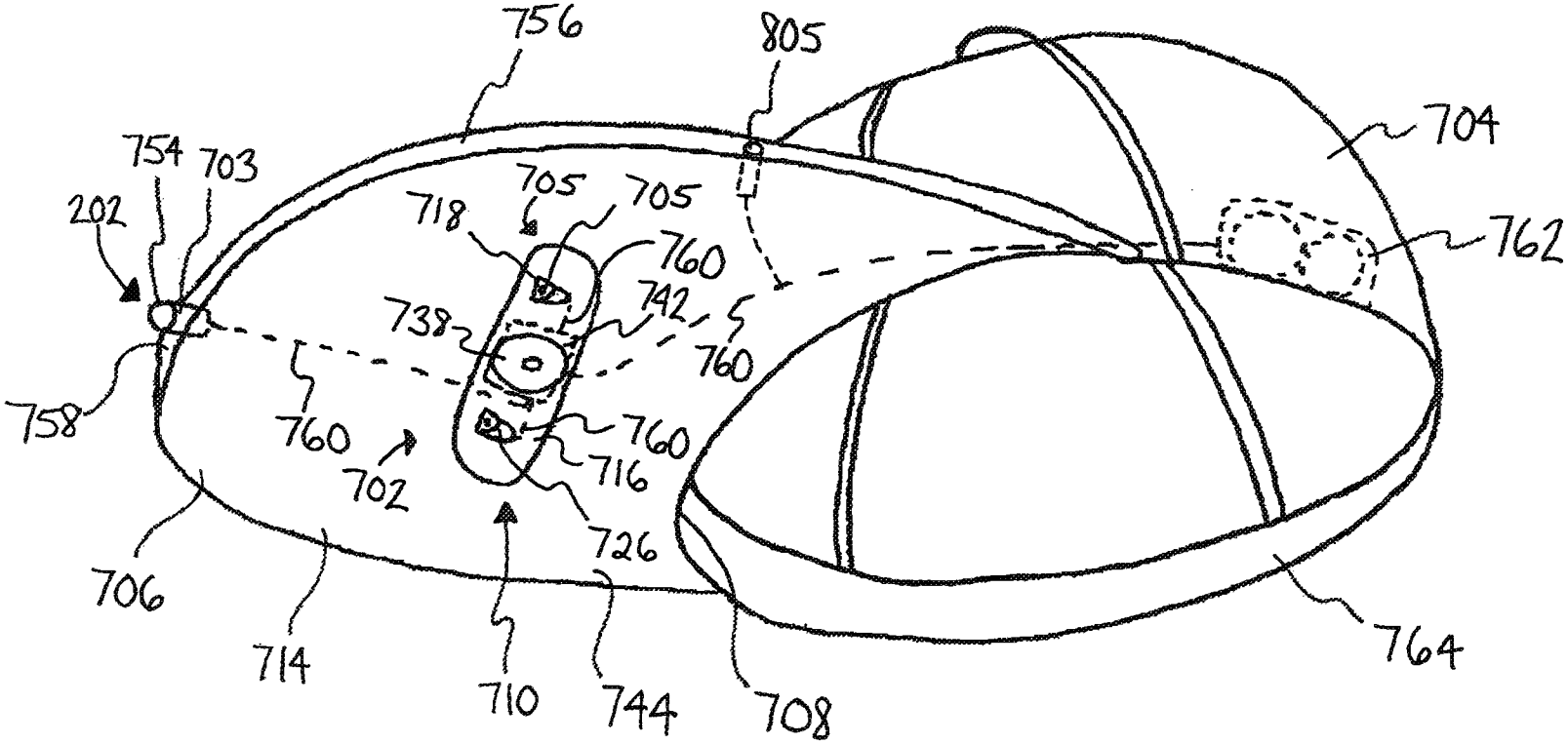
FIG. 24 is a bottom perspective view of a lighted hat showing a light holder housing LEDs at a bottom portion of the brim and an LED at a perimeter edge of the brim.
Figure 25:
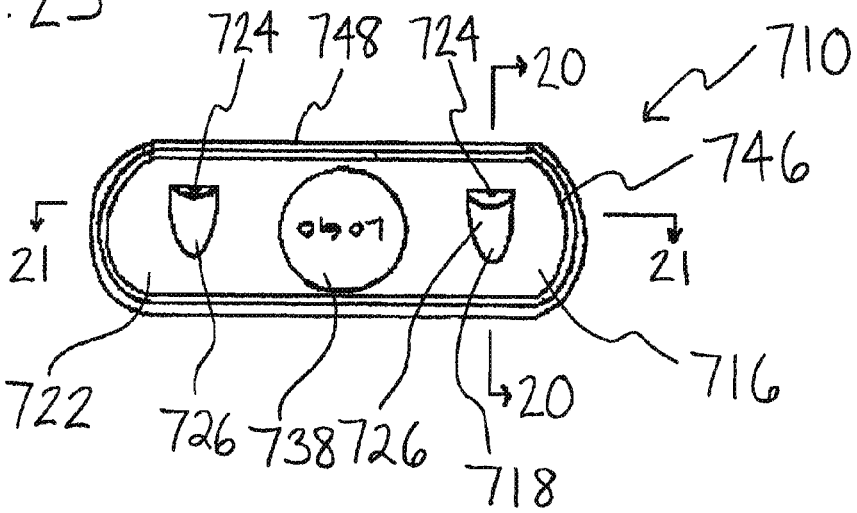
FIG. 25 is a bottom plan view of the light holder having two projections spaced from one another for receiving light sources, and a switch cover portion of the light holder.
Figure 26:
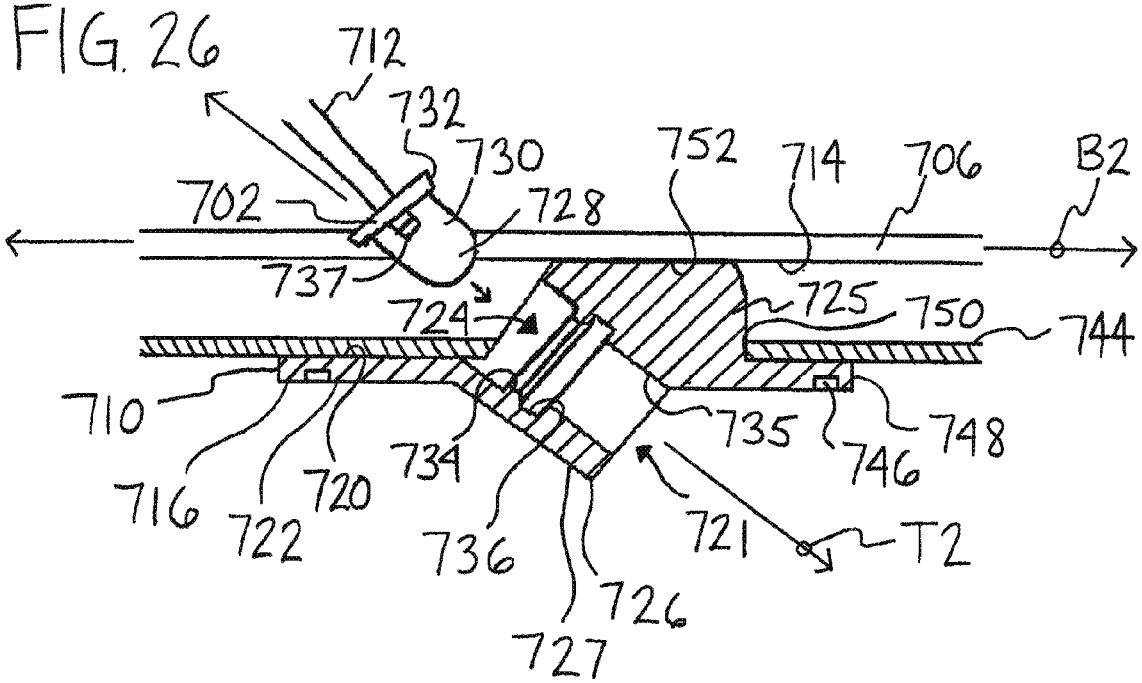
FIG. 26 is a side sectional view of the light holder of FIG. 25 showing the light holder attached to a hat brim with an offset to space the mounting base of the holder from the brim insert.

Referring to FIGS. 24-25, the external light holder 710 includes a mounting base 716 with an integral light holder portion 718. The mounting base 716 preferably has a generally thin and flat configuration, e.g. approximately 1 mm thick, to minimize the thickness of the mounting base 716 so that the brim 706, with the light holder 710 thereon, maintains a generally natural streamlined and thin appearance similar to a traditional brim. The mounting base 716 also includes an upper surface 720 configured to be positioned adjacent the outer lower major surface 714 of the brim 706 and a lower surface 722 configured to face an area below the brim 706. As discussed in more detail below, the upper surface 720 is attached to the outside of the covering material extending across the lower surface of the brim. By one approach, the upper and lower surface portions 720, 722 are generally rectangular with rounded ends to have a generally flat, racetrack configuration.

In the illustrated form, the holder portion 718 includes standoffs, offsets or ribs 725 projecting from the upper surface portion 720 (FIG. 26) and lighting housing portions or bezels 726 projecting from the opposite, lower surface portion 722, such as along the axis T discussed above. In one approach, the bezels 726 are in the form of a tubular housing having a cavity 724 therein for the light sources 705 with the axis T extending centrally therethough. In one example, the axis T can meet the brim axis B at an angle in the range of about 15 degrees to about 40 degrees. The bezels 726 are configured to at least partially receive and support at least a bottom surface 728 of the light sources 705. As illustrated, the housing portions 726 project along the axis T to minimize the material projecting downward from the lower major surface 714 of the brim 706 to minimize interference with a wearer's field of view. Preferably, an inner surface of each cavity 724 is sized and has a profile to substantially match the shape of the light sources 705 such as the lenses of the LED's so that the light sources 705 are tightly held in a fixed orientation therein. By one approach, the bezels 726 are more rigid than adjacent portions of the mounting base 716.

In one form, the light sources 705 are LEDs with a lens portion 730 and a radially projecting annular flange 732 positioned rearwardly from the lens portion 730. The cavities 724 can include an annular projection 734 followed longitudinally by an annular groove 736 sized to receive and hold the flange 732 of the light source 705. The projection 734 is configured to flex to allow the flange 732 past during installation of the light source 705 in the cavity 724 and thereafter to return to shape to rearwardly support the flange 732.

By one approach, the bezels 726 may have a longitudinal length such that a wall 727 forming the bezels extends beyond the lens portions 730 of the light sources 705. In this configuration, the light cone of the light source 705 may partially intersect with an inside surface 735 of the cavity 724. This allows the cavity 724 to protect the light source 705 from damage if the lighted hat 700 is dropped. Additionally, this configuration provides more focused light from the LED and keeps stray light from reaching the wearer's eyes and interfering with the gaze of the wearer because a distal end 721 of the cavity provides a blinder or blinder device positioned between the LED 705 and the wearer's eyes. If the wearer has glasses on, such stray light reaching the lenses of the glasses can caused undesirable glare when the lights are turned on. Alternatively, the bezels 726 may have a longitudinal length that extends axially beyond an illumination generating component, such as a light chip 737 of the light source 705, but not beyond the lens portion 730.

This configuration allows the light source 705 to provide a portion of more direct illumination to a location below the brim without substantial interference or reflection from the cavity 724 and also provides the blinder function as described above.

Figure 27:
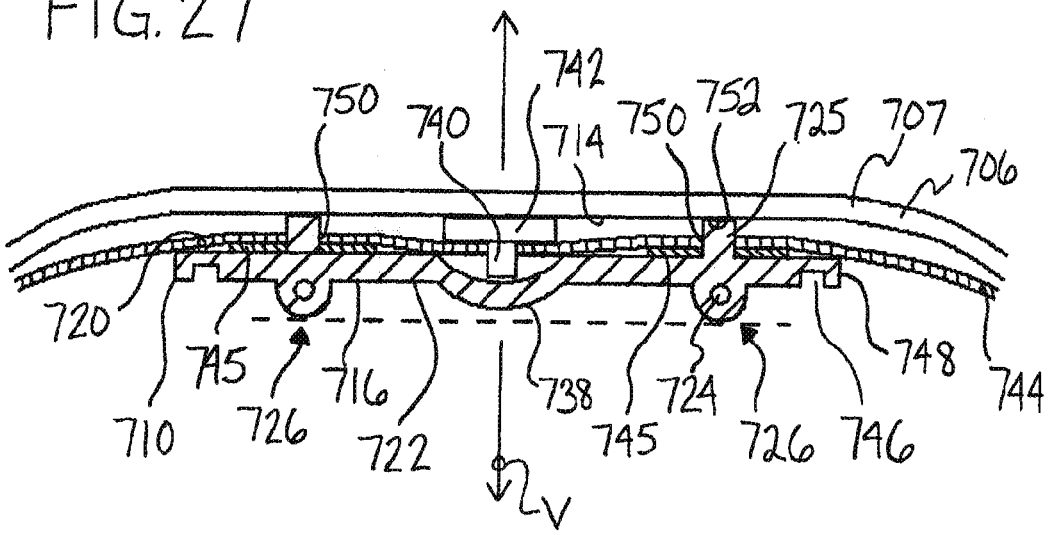
FIG. 27 is a front sectional view of the light holder of FIG. 25 showing a pair of offsets spacing the holder mounting base from the brim insert and including an arcuate configuration for the switch cover portion positioned adjacent a switch actuator.
Figure 30:
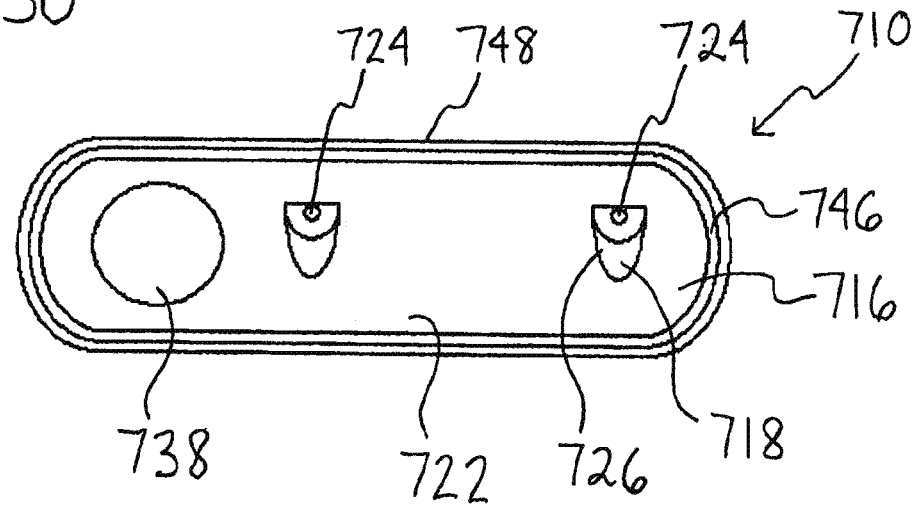
FIG. 30 is a top plan view of an alternative light holder having a different arrangement of the upwardly projecting offsets for receiving lights sources therein and the switch cover portion.
Figure 29:
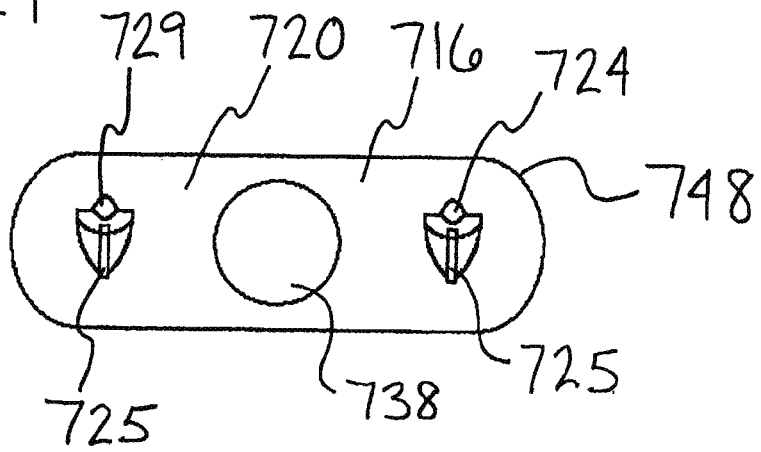
FIG. 29 is a top plan view of another light holder having a mounting base including two projections for receiving light sources and a switch cover portion with the projections including ribs as additional offsets.

The light holder 710 further includes a switch covering portion 738 (FIG. 25). The switch covering portion 738 can be positioned intermediate of the housing portions 726 along the base 716 as illustrated in FIGS. 25, 27, and 29, to one side of the housing portions 726 on the base 716 as illustrated in FIG. 30, or other suitable locations, such as generally in front or back of the housing portions 726. The switch covering portion 738 can be a portion of flexible outwardly curved or convex material, which can be utilized to identify the location of the hat switch 742 and/or to provide a space into which a pushbutton actuator 740 of the switch 742 can be located as shown in FIG. 27. The switch 742 then electrically connects to the light sources 705 to control power thereto. Preferably, the bezels 726 extend further down a vertical axis V that extends generally perpendicular to the brim axis B than the switch covering portion 738. Thus, the bezels 726 act as a switch guard to block in some cases, unintended activation of the switch because the bezel may stop an adjacent surface (such as a nested hat brim for example) from engaging the switch 742. This may also provide protection on sides of the switch 742 adjacent to the housing portions 726, such as against unwanted actuation of the switch 742 or damage to the switch 742 from dropping the hat or the like. Alternatively, the switch 742 can be spaced from the light holder 710, such as discussed above.

As previously mentioned, the external light holder 710 can be of rubber or elastomeric material. As such, the light holder 710 can be formed by molding which allows for indicia, such as a company brand or product name, to be readily molded into the lower surface 722 thereof. To this end, the switch covering portion 738 may further include alphanumeric and/or graphical content, such as a company trademark.

The light sources 705 disposed in the light holder 710 may be high intensity LEDs that output high intensity cones of light. In such an instance, the light holder 710 may further include a heat sink 745 therein, such as composed of aluminum, tin, or other conductive material to spread out the heat generated by the LEDs. The heat sink 745 may be in thermal communication with the LEDs and positioned around the cavities 724, sandwiched between the holder and brim, extending through portions of the mounting base 716, or in other appropriate locations in the hat brim.

Figure 28:
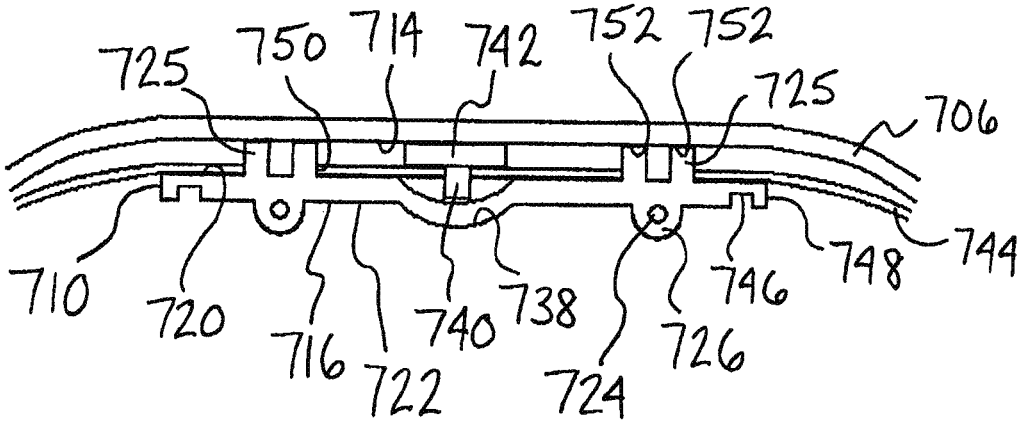
FIG. 28 is a front sectional view of an alternative light holder showing each offset in the form of a pair of rib projections to space the holder mounting base from the brim insert.

In this embodiment, the light holder 710 is attached to the outside of the lower major surface 714 of the brim 706, such as by stitching, staples, adhesive, welding, or the like, and more preferably to a outer covering material 744 disposed on the lower major surface 714 of the brim 706 as best shown in FIGS. 24, 26, 27, and 28. To this end, the light holder 710 may include a groove or channel 746 adjacent a perimeter edge 748 of the light holder 710. The groove 746 advantageously provides a thinner cross section through which a needle or staple may pass to secure the holder to the brim or, alternatively, substantially conceals threading, staples, or other mechanical fastening element from view because such fastener is received within the groove 746. Additionally, openings 750 (FIGS. 26, 27, and 28) may be provided in the covering material 744 through which the offsets or ribs 725 can extend so that the holder 710 (and in particular the holder base 716 thereof) can be mounted flush to the brim. Beneficially, the offsets 725 can include an upper shoulder 752 configured to abut or contact the lower major surface 714 of the brim 707, such as to space the mounting base 716 from the lower major surface 714 of the brim 707. The switch 742, discussed above, can then be positioned within this small space provided by the offsets 725 in alignment with the switch covering portion 738, as illustrated in FIGS. 27 and 28. FIG. 28 provides an alternative form in which the offsets include a pair of spaced ribs 725, which provides a more stable engagement of the holder 716 to the lower surface of the brim 706. FIG. 29 provides yet another alternative form of the offsets or ribs 725 where an upper portion of the bezels 726 extend through the base 716 and project beyond the upper surface 720. In this form, the ribs 725 are mounted to rear portions of the bezels 726.

Referring back to FIG. 24, the lighted hat 700 further includes at least one upper light source 754 mounted to a perimeter edge 756 of the brim 706, and preferably a front edge 758 of the brim 706, which may include a relatively narrow cone of light, such as about a 15 degree to a about 20 degree light cone. The upper light source 754 is positioned to extend from the perimeter edge 756 of the hat brim 706 to direct light forwardly of the wearer. The upper LED can be received in a central, forward notch of the brim 707 and be tightly engaged thereabove and therebelow by the upper and lower fabric covering material to be captured therebetween. By one approach, the upper light source 754 extends generally parallel to the brim axis B. By another approach, the upper light source 754 can be canted relative to the brim axis B from 0 degrees to about 15 degrees downwardly from the brim axis B, and preferably 5 to 15 degrees. More particularly, the upper light source 754 may be a 20,000 MCD light emitting diode having a 20 degree light cone that is canted downwardly from the brim axis B extending through the hat brim 706 by about 5 degrees. Together the upper light source 754 and the downward light sources 705 received in the light holder 710 may illuminate multiple distances.

As illustrated in FIG. 24, electrical connections 760 extend between the switch 742, the lower light sources 705, the upper light source 754, and a power source 762, such as batteries mounted to the crown 704 and specifically the sweatband 764 thereof, or other electrical generation mechanisms. The electrical connections 760, such wiring, may be disposed adjacent the brim 706 or within grooves provided in the brim 706 and specifically in the brim insert 287 or simply captured between the insert and fabric covering. So configured, the switch 742 can be actuated to light the light sources 705, 754 sequentially independently from each other or simultaneously so a wearer of the lighted hat can illuminate areas at different distances. As shown, the power source is in the hat crown, but this is only exemplary as the power source may be located anywhere on the hat.

Referring now to FIGS. 31-39, alternative configurations of lighting on a hat brim 800 to project light to at least two different areas and/or directions are provided. In general, these embodiments are described with the brim 800 having an upper major surface 802 and a lower major surface 804, which may have an upper fabric covering portion 806 and/or a lower fabric covering portion 808 disposed thereon, respectively. The below embodiments are described with respect to the positioning of one or more light sources 810 and different brim configurations. It is to be understood that the light sources 810 can be electrically coupled to a power source disposed on or within the brim 800 or other portion of the hat, such as a crown portion. The configurations may further include a switch electrically coupled to the light sources 810 and the power source to control power to the light sources 810. The switch may be disposed on the brim 800 or other portions of the hat, such as the crown. Each of the embodiments of FIGS. 31-39 can be used individually, in any combination, or combined with any of the previously described embodiments.

Figure 31:
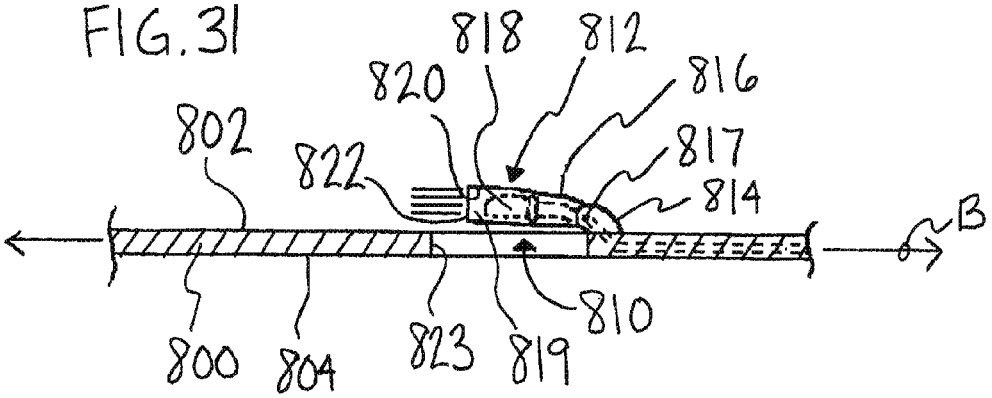
FIG. 31 is a side sectional view of a pivoting light module mounted to a brim of a hat showing the light module pivoted to a forward facing configuration.
Figure 32:
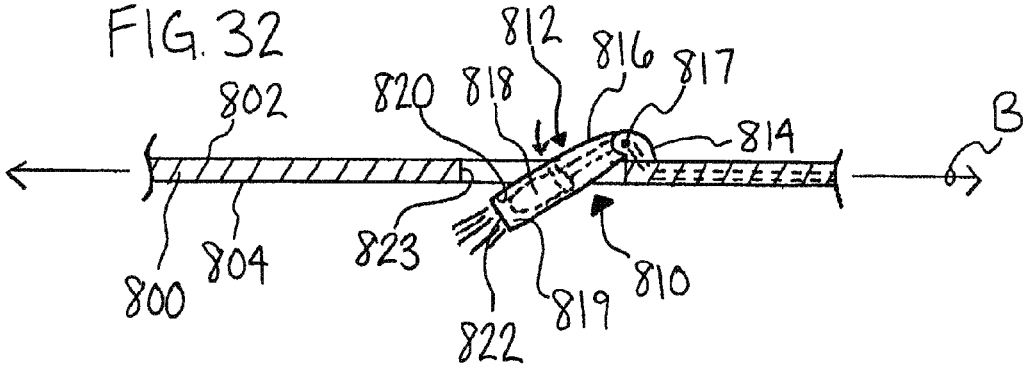
FIG. 32 is a side sectional view of the pivoting light module of FIG. 31 showing the light module pivoted to a downwardly and forwardly facing configuration.

In the embodiment of FIGS. 31 and 32, a pivoting module 812 is mounted to or adjacent the upper major surface 802 of the brim 800, may be contained within a cavity formed in the brim 800, or mounted about the brim 800. The pivoting module 812 includes a pivot base 814 mounted to the brim 800, and is preferably secured to or through the upper fabric covering portion 806 by adhesive, stitching, hardware, welding, or the like. The base 814 rotatably or pivotably attaches to a light module 816 through a pivot point 817 extending generally transverse to the brim axis B. The light module 816 includes a cavity 819 therein configured to receive at least one light source 818 such that the light source 818 projects light forwardly of the module 816. In one approach, an inner surface 820 of the module cavity 819 includes a reflective coating, material, or layer so that portions of a light cone projected from the light source 818 contacting the inner surface 820 are reflected back into the forwardly projecting light beam to project out of an opening 822 in the front of the projection portion 816. The opening 822 may have a transparent or translucent covering or window disposed thereacross to provide further protection for the light source 818. To facilitate pivoting, the brim 800 may also include an opening or cut-out 823 sized to allow the module 816 to pivot downwardly therethrough, as shown in FIG. 32. So configured, the light module 812 can be manipulated by a wearer to pivot up and down between a forwardly directing position, as shown in FIG. 31 above the brim, and a downwardly directing position, such as shown in FIG. 32 extending through and below the brim. Preferably, the light module 812 is configured to maintain positioning at any desired angle, such as by pressure fitting the pivot point 817, tightening the pivot point 817, having a plurality of notches or grooves cooperating with ridges between the base 814 and the module 816, or the like.

Figure 33:
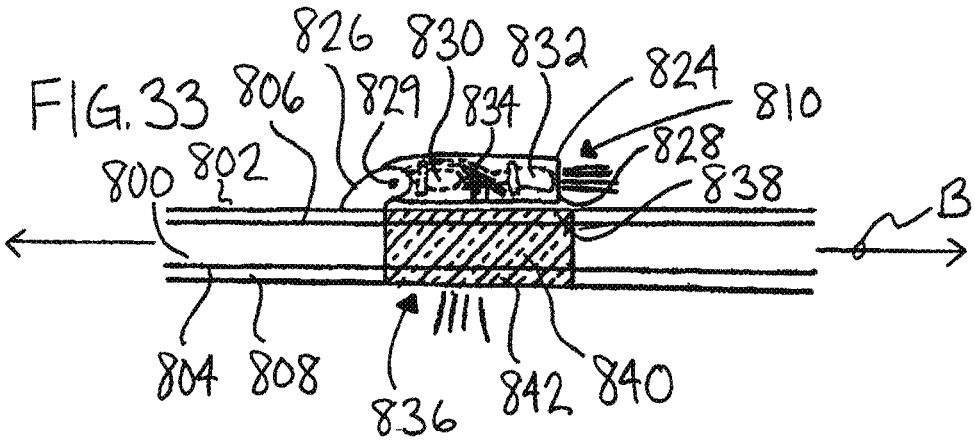
FIG. 33 is a side sectional view of a light module mounted to a brim with a transparent portion showing the light module projecting light in forward and downward directions through use of a light redirecting member.

In FIG. 33, another embodiment of a light module 824 is shown mounted to or adjacent the upper major surface 802 of the brim 800. The light module 824 includes a pivot base 826 mounted to the upper major surface 802, such as to or through the upper fabric covering portion 806 by adhesive, stitching, hardware, welding, or the like. The base 826 rotatably or pivotably attaches to a projection module 828 through a pivot point 829 extending generally transverse to the brim axis B. The projection module 828 is sized to receive one or more light sources 810, and preferably two light sources 810 therein. Preferably, the module 828 includes the two light sources both facing in the forward direction, but one is configured as a downward light source 830 and the other is configured as a forwardly directing light source 832. In one form, the downwardly projecting light source 830 can be secured within the projection module 828 to direct light in a generally downward direction and the forwardly projecting light source 832 can be secured within the projection module 828 to direct light in a generally forward direction along the brim axis B. Both light sources 830 and 832 can be oriented along the brim axis B with a light redirecting mechanism 834 (i.e. prism, mirror, and the like) positioned in front of the downward light 830 to redirect light emitted from the downwardly projecting light source 830 generally downwardly and transverse to the axis B. That is, both lights 830 and 832 project light along the brim axis B, but the light redirecting mechanism 834 redirects the light beam from the light source 830 to be projected at an oblique angle to the brim axis B. In one form, the light redirecting mechanism 834 is adjustable to allow a wearer of the hat to alter the direction of illumination to a variety of distances below and/or forwardly of the brim 800. The brim 800 further includes a window 836 of transparent or translucent material positioned adjacent the projection module 828, and preferably along the path of downward light projection to allow the downwardly projected light from the light source 830 and light redirecting mechanism 834 to pass through the window 836 to an area below the brim 800. As illustrated, the window 836 extends through the brim 800 and may include an upper brim window portion 838, a middle brim window portion 840, and a lower brim window portion 842, where each portion is transparent or translucent. Alternatively, the window 836 could be a single piece secured to the brim 800 and the fabric covering portions 806, 808 or an opening could be provided through the brim 800 and/or the fabric covering portions 806, 808 to at least partially allow the light cone projected by the downwardly directed light source 830 to pass therethrough.

Figure 34:
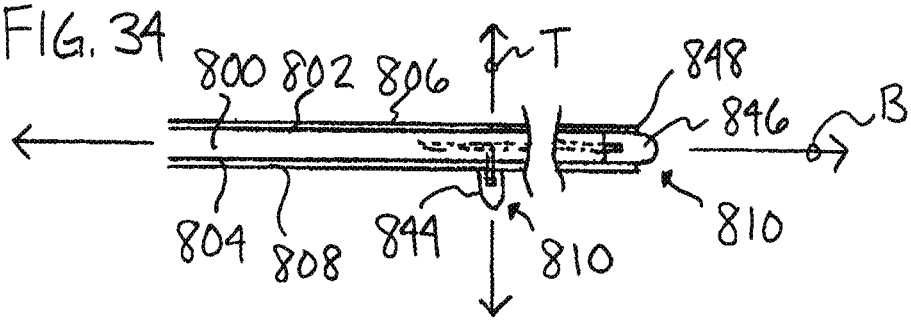
FIG. 34 is a side sectional view of a brim for a hat having a forwardly facing LED mounted to a perimeter of the brim and a downwardly facing LED mounted to an underside of the brim through a brim fabric covering.
Figure 35:
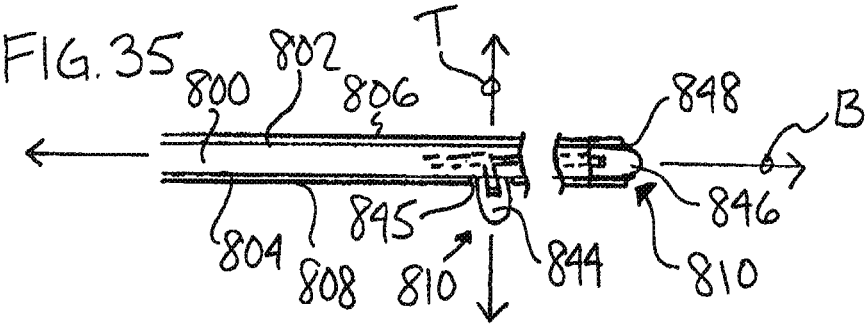
FIG. 35 is a side sectional view of a brim for a hat having a forwardly facing LED mounted to a perimeter of the brim and a downwardly facing LED mounted to an underside of the brim within an opening in a brim fabric covering.

Next, FIGS. 34 and 35 illustrated yet another embodiment of a lighted hat to project illumination in multiple directions. In this embodiment, the brim 800 includes at least two light sources 810 to direct light in two different areas. Specifically, a lower light source 844 is mounted to the lower major surface 804 of the brim 800, such as through the lower fabric covering portion 808, as illustrated in FIG. 34. Alternatively, the lower light source 844 may extend through an opening 845 provided in the lower fabric covering portion 808, as illustrated in FIG. 35. The lower light source 844 can be mounted generally perpendicular to the brim axis B to direct illumination along the axis T as shown, or can be mounted at an angle to the brim axis B to direct light to a more forwardly position, as discussed above. The brim 800 further includes an upper light source 846 mounted to a perimeter 848 of the brim 800 generally along the brim axis B. The upper light source 846, however, may be slightly angled with respect to the brim axis B, as discussed above. So configured, the upper and the lower light sources 846, 844 are mounted to the brim 800 to provide light to different directions and/or areas and in particular illumination in directions that are perpendicular to each other.

Figure 36:
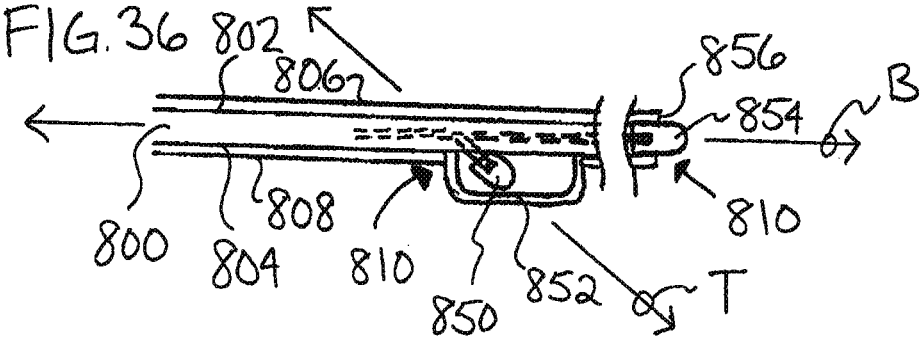
FIG. 36 is a side sectional view of a brim for a hat having a forwardly facing LED mounted to a perimeter of the brim and a downwardly facing LED mounted to an underside of the brim within a canopy portion of the brim underside covering the downwardly facing LED.

Yet another embodiment is illustrated in FIG. 36. In this embodiment, the brim 800 again includes at least two light sources 810 to direct light in two different areas or along two different axes. Specifically, a lower light source 850 is mounted to the lower major surface 804 of the brim 800. In this embodiment, the brim 800 and/or the lower fabric covering portion 808 thereof includes a downwardly projecting canopy or enclosure 852 that houses the lower light source 850 underneath the brim 800. The canopy 852 is preferably transparent or translucent or has a transparent or translucent window portions thereof so that light projected from the lower light source 850 can pass therethrough to illuminate an area below the brim 800. Alternatively, the lower fabric covering portion 808 itself may be sufficiently transparent or translucent so that the light from the light source 850 can project therethrough. As illustrated, the lower light source 850 is canted with respect to the brim axis B to extend along the axis T; however, other angles can be utilized as discussed above. In one form, the canopy 852 can be formed of a generally stiff material to provide protection for the lower light source 850 from damage, such as when the hat is dropped or stacked. In another form, the canopy 852 can be formed of a generally flexible material, so that a wearer can manipulate the canting of the lower light source 850. This embodiment further includes an upper light source 854 mounted to a perimeter 856 of the brim 800 generally along the brim axis B. The upper light source 854, however, may also be slightly angled with respect to the brim axis B, as discussed above.

Figure 37:
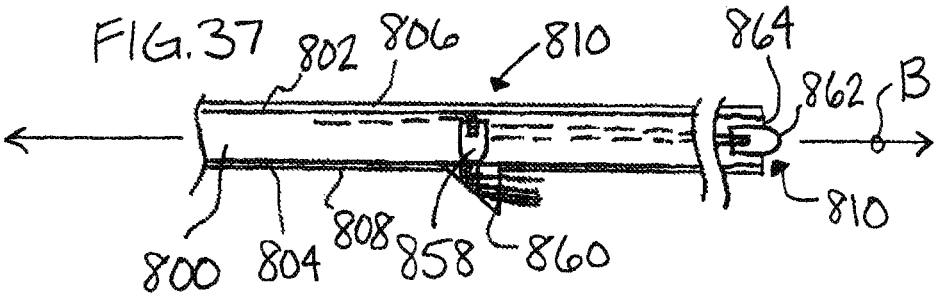
FIG. 37 is a side sectional view of a brim for a hat having a forwardly facing LED mounted to a perimeter of the brim and a downwardly facing LED mounted at least partially within the brim and configured to project light to a redirecting member mounted to an underside of the brim.

Turning to FIG. 37, another embodiment is illustrated with the brim 800 having at least two light sources 810 to direct light in two different areas or directions. A lower light source 858 is received within the brim 800 such as in a cavity or other space therein and is substantially concealed from view. The lower light source 858 is preferably secured in a downward direction transverse, and in some approaches perpendicular, to the brim axis B, as illustrated in FIG. 37. A light redirecting mechanism 860 (i.e. prism, mirror, and the like) is mounted to the lower major surface 804 of the brim 800 in a position below the lower light source 858 so that the mechanism 860 redirects light projected downwardly from the lower light source 858 to a more forward direction, such as along the brim axis B. In one form, the mechanism 860 can pivot relative to the brim axis B so that a user may also redirect light from the light source 858 to a range of areas by altering the angle of the mechanism 860 so that the lower light source 858 can project light into the reading or viewing area discussed with the previous embodiments. An upper light source 862 can additionally be mounted to a perimeter 864 of the brim 800 generally along the brim axis B. The upper light source 862, however, may also be slightly angled with respect to the brim axis B, as discussed above.

Figure 38:
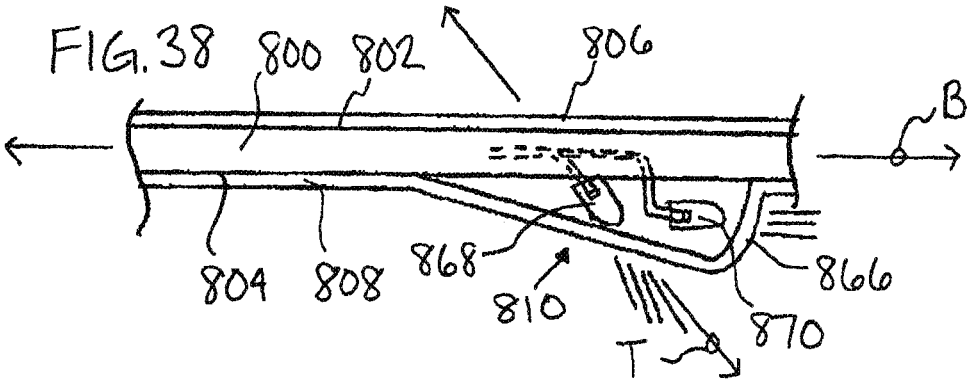
FIG. 38 is a side sectional view of a brim for a hat having a forwardly facing LED and a downwardly facing LED both mounted to an underside of the brim and within a canopy portion of the brim underside.

In FIG. 38, the brim 800 includes at least two light sources 810 mounted to the lower major surface 804 to direct light to different areas or in different directions. The brim 800 and/or the lower fabric covering portion 808 includes a downwardly extending canopy or enclosure 866 that encloses both light sources 810 therein between the lower major surface 804 of the brim 800 and the canopy 866. Preferably, the canopy 866 may be generally wedge shaped and formed from transparent or translucent materials and/or includes one or more transparent or translucent windows adjacent each light source. In this form, the canopy includes the light sources 810 with a downwardly directed light source 868 that extends and projects illumination along the axis T and a forwardly directed light source 870 that projects illumination along the brim axis B, as discussed above. The light source 870 can alternatively be angled with respect to the brim axis B, as discussed above. In one form, the canopy 866 can be formed of a generally stiff material to provide protection for the light sources 868, 870 from damage, such as when the hat is dropped or stacked. In another form, the canopy 866 can be formed of a generally flexible material, so that a wearer can manipulate the canting of the light sources 868, 870 as desired. As shown, the canopy 866 is a wedge-like enclosure depending below the brim lower surface 804 to minimize the thickness of the brim.

Figure 39:
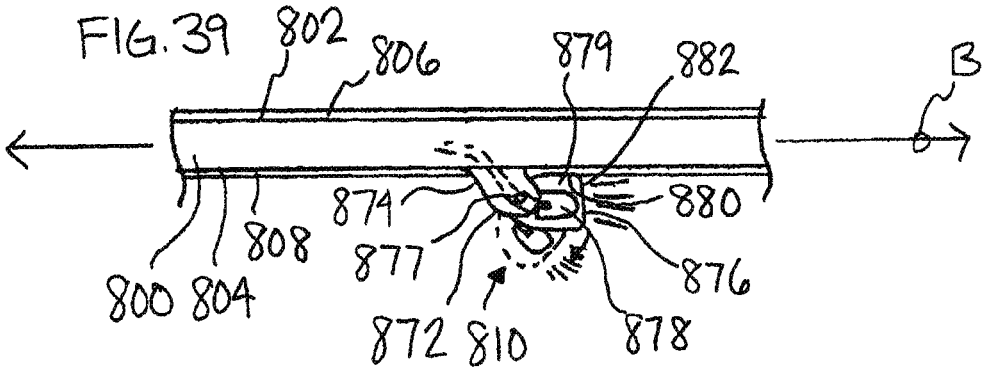
FIG. 39 is a side sectional view of a brim for a hat having a rotatable lamp mounted to an underside of the brim showing the lamp rotating between a forwardly facing position and a downwardly facing position.

In FIG. 39 a pivoting light module 872 is mounted to the lower major surface 804 of the brim 800, such as to or through the lower fabric covering portion 808. The light module 872 includes a pivot base 874 mounted to the lower major surface, such as by adhesive, stitching, hardware, welding, or the like. The light module 872 further includes a projection module 876 rotatably or pivotably attached to the base 874 through a pivot point 877 generally transverse to the brim axis B. The projection module 876 includes a hollow interior forming a cavity 879 sized to receive at least one light source 878 therein. By one approach, an interior surface 880 of the module cavity 879 may include a reflective coating, layer, or materials disposed at least partially thereon so that portions of a light cone emitted from the light source 878 that contact the interior surface 880 are reflected to project out of an opening 882 of the projection module 876. The opening 882 may further include a transparent or translucent window or covering thereacross to provide further protection for the light source 878. So configured, the projection module 876 can be manipulated to a range of positions between a first position to direct light generally forwardly and along the brim axis B to a second position directing light perpendicular to the brim axis B as well as an infinite number of positions therebetween. This allows a wearer of the lighted hat to alter the illumination direction of the light source 878. This can be achieved, for example by pressure fitting the pivot point 877, tightening the pivot point 877, having a plurality of notches or grooves cooperating with ridges between the base 874 and the module 876, or the like.

It will be understood that various changes in the details, materials, and arrangements of the parts and components that have been described and illustrated in order to explain the nature of the lighted hats as claimed may be made by those skilled in the art within the principle and scope of the invention.

What is claimed is:

1. A light mount for mounting a light source to headgear, the light mount comprising:

a single-piece light holder body for holding a light source in a predetermined fixed orientation and having a laterally extending upper surface with a fore-and-aft axis extending thereacross;

a cavity in the light holder body sized to receive the light source therein, the cavity extending at an inclination to the fore-and-aft axis along an inclined axis so that a light source received therein projects light along the inclined axis in the predetermined fixed orientation; and an opening to the cavity in the upper surface to allow electrical connections of the light source to pass therethrough.

2. The light mount of claim 1 wherein the light holder body comprises a mounting base including the upper surface of the light holder body and a light holder portion extending from the mounting base, the light holder portion having the cavity therein.

3. The light mount of claim 2 wherein the light holder portion includes two cavities therein for receiving two corresponding light sources.

4. The light mount of claim 3 wherein the cavities within the light holder portion extend along different inclined axes with respect to one another and with respect to the fore-and-aft axis.

5. The light mount of claim 2 in combination with the light source, wherein the light source includes an illumination element, and the light holder portion includes an annular wall portion that extends about the cavity such that with the light source received within the cavity, an end portion of the annular wall portion extends beyond the illumination element for blocking incident light.

6. The light mount of claim 1 wherein the light holder body includes two cavities therein laterally spaced from one another between about 35 millimeters and about 65 millimeters.

7. The light mount of claim 1 wherein the inclined axis of the cavity extends at an angle of between about 15 degrees and about 40 degrees with respect to the fore-and-aft axis.

8. The light mount of claim 1 in combination with the headgear, the headgear including:

a head fitting portion for fitting on a user's head;

a brim portion including a shape retentive brim member having upper and lower major surfaces thereof, and a covering material extending over the shape retentive brim member; and wherein the light holder body is mounted to the brim portion so that the upper surface thereof abuts the brim portion and the inclined axis of the cavity is oriented so that a light source received therein provides illumination downwardly and forwardly away from the brim portion.

9. The combination of claim 8 wherein an upper portion of the light holder body including the upper surface thereof is of a resilient material so as to be flexible to at least partially conform to a curvature of the brim portion.

10. The combination of claim 8 wherein the light holder body upper surface abuts the lower major surface of the shape retentive brim member and at least a portion thereof extends through an opening in the covering material so that with the light source received in the cavity, illumination is provided in a direction downwardly and forwardly away from the brim portion.

11. The combination of claim 10 wherein the light holder body upper surface is flush with the shape retentive brim member lower major surface.

12. Lighted headgear comprising:

a head fitting portion for fitting on a user's head;

a brim portion including a shape retentive brim member having upper and lower major surfaces thereof, and a covering material extending over the shape retentive brim member;

a light mount for mounting a light source to headgear, the light mount including:

a light holder body for holding a light source in a predetermined fixed orientation and having a laterally extending upper surface with a fore-and-aft axis extending thereacross;

a cavity in the light holder body sized to receive the light source therein, the cavity extending at an inclination to the fore-and-aft axis along an inclined axis so that a light source received therein projects light along the inclined axis in the predetermined fixed orientation; and an opening to the cavity in the upper surface to allow electrical connections of the light source to pass therethrough;

wherein the light holder body comprises a mounting base including the upper surface of the light holder body and further including an opposite lower surface, and a light holder portion extending from the mounting base lower surface and having the cavity therein; and the light holder body is mounted to the brim portion such that at least a portion of the mounting base is disposed between the lower major surface of the shape retentive brim member and the covering material and the light holder portion extends through the opening in the covering material such that the inclined axis of the cavity is oriented so that a light source received therein provides illumination downwardly and forwardly away from the brim portion.

13. The lighted headgear of claim 12 wherein the light holder portion extends generally along the inclined axis of the cavity such that the light holder portion connects to the mounting base at an acute angle at a forward surface thereof so that the covering material extending between the light holder portion and the mounting base is sandwiched therebetween.

14. The lighted headgear of claim 12 wherein the mounting base is attached to the shape retentive brim member.

15. The lighted headgear of claim 12 wherein the covering material includes an embroidered patch having a greater thickness than adjacent portions of the covering material, the mounting base extending between the overlying shape retentive brim member and the underlying embroidered patch.

16. The lighted headgear of claim 15 wherein the mounting base has a footprint and the embroidered patch is sized to be slightly larger than the footprint of the mounting base.

17. The lighted headgear of claim 15 wherein the embroidered patch is stiffer than adjacent portions of the covering material providing more support for the light holder body.

18. The lighted headgear of claim 15 wherein the mounting base and the embroidered patch include an adhesive therebetween to secure the light holder body to the embroidered patch with the embroidered patch comprised of non-wicking material so that the adhesive is impeded from traveling through the covering material.

19. The combination of claim 8 further comprising a lighting assembly mounted to the headgear, the lighting assembly including a light source received in the cavity of the light holder body, a power source mounted to the headgear, and a switch device mounted to the brim portion between the shape retentive brim member and the covering material.

20. Lighted headgear comprising:

a head fitting portion for fitting on a user's head;

a brim portion including a shape retentive brim member having upper and lower major surfaces thereof, and a covering material extending over the shape retentive brim member;

a light mount for mounting a light source to headgear, the light mount comprising:

a light holder body for holding a light source in a predetermined fixed orientation and having a laterally extending upper surface with a fore-and-aft axis extending thereacross;

a cavity in the light holder body sized to receive the light source therein, the cavity extending at an inclination to the fore-and-aft axis along an inclined axis so that a light source received therein projects light along the inclined axis in the predetermined fixed orientation, the light holder body mounted to the brim portion so that the inclined axis of the cavity is oriented so that a light source received therein provides illumination downwardly and forwardly away from the brim portion; and an opening to the cavity in the upper surface to allow electrical connections of the light source to pass therethrough;

a lighting assembly mounted to the headgear, the lighting assembly including a light source received in the cavity of the light holder body, a power source mounted to the headgear, and a switch device mounted to the brim portion between the shape retentive brim member and the covering material;

wherein the covering material includes embroidered stitching that at least partially extends below the switch device, the embroidered stitching providing greater rigidity to the covering material than adjacent portions thereof for pushing on the embroidered stitching to depress an actuator of the switch device.

21. The combination of claim 19 wherein the lighting assembly further includes another light source mounted to the brim portion at or adjacent a perimeter edge thereof so that the light source is oriented to project light forwardly of the headgear.

22. Lighted headgear comprising:

a head fitting portion for fitting on a user's head;

a brim portion extending in a forward direction along a fore-and-aft axis from the head fitting portion;

a light source for projecting illumination from the brim portion;

a single-piece light holder mounted to the brim portion for holding the light source in a predetermined fixed orientation;

a light holder portion of the light holder having a cavity therein sized to receive the light source, the light holder portion extending away from the brim portion at a fixed angle along an inclined axis relative to the fore-and-aft axis to provide illumination downwardly and forwardly away from the brim portion.

23. The lighted headgear of claim 22 wherein the light holder further includes a mounting base integral with the light holder portion with the light holder portion extending away from the mounting base, the mounting base having a greater flexibility than the light holder portion.

24. The lighted headgear of claim 23 wherein the brim portion includes a shape retentive brim member and covering material extending over the shape retentive brim member; and the mounting base is fixed between the shape retentive brim member and the covering material so that the light holder portion at least partially extends through an opening in the covering material.

25. Lighted headgear comprising:

a head fitting portion for fitting on a user's head;

a brim portion extending in a forward direction along a fore-and-aft axis from the head fitting portion, the brim portion including a shape retentive brim member and covering material extending over the shape retentive brim member;

a light source for projecting illumination from the brim portion;

a light holder mounted to the brim portion for holding the light source in a predetermined fixed orientation;

a light holder portion of the light holder having a cavity therein sized to receive the light source, the light holder portion extending away from the brim portion at a fixed angle along an inclined axis relative to the fore-and-aft axis to provide illumination downwardly and forwardly away from the brim portion;

a mounting base of the light holder integral with the light holder portion thereof with the light holder portion extending away from the mounting base, the mounting base having a greater flexibility than the light holder portion and being fixed between the shape retentive brim member and the covering material so that the light holder portion at least partially extends through an opening in the covering material;

wherein the covering material includes an embroidered portion extending around the opening that provides a relatively stiffer mounting surface for the mounting base than adjacent portions of the covering material.

26. The lighted headgear of claim 25 wherein mounting base has a footprint, and the embroidered portion is sized to be at least slightly larger than the footprint of the mounting base.

27. The lighted headgear of claim 22 further comprising another light source mounted to the brim portion at or adjacent a forward perimeter edge thereof so that the light source is oriented to project light forwardly of the headgear.

* * * * *